US008216036B2

(12) United States Patent
Eyzaguirre et al.

(10) Patent No.: US 8,216,036 B2
(45) Date of Patent: Jul. 10, 2012

(54) ENTERTAINMENT SYSTEM AND METHOD

(75) Inventors: Adriana Maria Eyzaguirre, London (GB); Peter John Hodges, London (GB)

(73) Assignee: Sony Corporation Entertainment Europe Limited (GB)

( * ) Notice: Subject to any disclaimer, the term of this patent is extended or adjusted under 35 U.S.C. 154(b) by 263 days.

(21) Appl. No.: 12/595,075

(22) PCT Filed: May 27, 2008

(86) PCT No.: PCT/GB2008/001790

§ 371 (c)(1), (2), (4) Date: Apr. 26, 2010

(87) PCT Pub. No.: WO2008/145980

PCT Pub. Date: Dec. 4, 2008

(65) Prior Publication Data

US 2010/0203933 A1 Aug. 12, 2010

(30) Foreign Application Priority Data

May 31, 2007 (GB) ..... 0710459.9

(51) Int. Cl.
*A63F 13/00* (2006.01)

(52) U.S. Cl. ..... 463/2; 463/31; 463/34; 463/40; 463/46

(58) Field of Classification Search ..... 463/2, 31, 463/34, 40, 46
See application file for complete search history.

(56) References Cited

U.S. PATENT DOCUMENTS

2005/0186884 A1 8/2005 Evans

FOREIGN PATENT DOCUMENTS

| | | | |
|---|---|---|---|
| DE | 19902852 | C1 | 7/2000 |
| EP | 1310280 | A | 5/2003 |
| FR | 2849522 | A | 7/2004 |
| WO | 0156676 | A | 8/2001 |
| WO | 0195988 | A1 | 12/2001 |

(Continued)

OTHER PUBLICATIONS

International Search Report dated Sep. 22, 2008 from the corresponding PCT/GB2008/001790.

(Continued)

*Primary Examiner* — Peter DungBa Vo
*Assistant Examiner* — Jeffrey Wong
(74) *Attorney, Agent, or Firm* — Lerner, David, Littenberg, Krumholz & Mentlik, LLP

(57) ABSTRACT

An entertainment system comprises a remotely controlled toy having a video camera operable to capture video images of a real environment and an entertainment device operable to communicate using a data communications link with the remotely controlled toy, in which the device comprises transmitting means operable to transmit, via the data communications link, control data to the remotely controlled toy that relates to the control of the remotely controlled toy, receiving means operable to receive, from the data communications link, video images captured by the video camera—of the remotely controlled toy, detecting means operable to detect a real environment feature within the real environment, processing means operable to generate a virtual image feature in dependence upon the detected real environment feature, and displaying means operable to generate a combined display of the captured video images and the virtual image feature such that the virtual image feature is arranged with respect to the video images so as to correspond to the position of the real environment feature within the real environment.

42 Claims, 9 Drawing Sheets

FOREIGN PATENT DOCUMENTS

| | | | |
|---|---|---|---|
| WO | 2006056231 | A1 | 6/2006 |
| WO | 2006105686 | A1 | 10/2006 |
| WO | 2007050218 | A2 | 5/2007 |

OTHER PUBLICATIONS

International Search Report dated Jan. 27, 2009 from the corresponding PCT/GB2008/001790.

UK Combined Search and Examination Report under Sections 17 and 18(3) dated Sep. 28, 2007 from the corresponding GB0710459.9.

UK Search Report under Section 17(6) dated Apr. 30, 2008 from the corresponding GB0710459.9.

European Search Report dated Aug. 28, 2009 from the corresponding 09008965.7-2318.

European Search Report dated Aug. 31, 2009 from the corresponding 09008964.0-2318.

Kevin Ponto, Falko Kuester, Robert Nideffer, Simon Penny; "Virtual Bounds: a teleoperated mixed reality"; Virtual Reality (2006) 10: 41-47, DOI 10.1007/s10055-006-0030-x; Received: Dec. 22, 2005/ Accepted: Apr. 3, 2006/ Published online: Apr. 26, 2006; Springer-Verlag London Limited 2006; pp. 41-47.

International Preliminary Report on Patentability dated Dec. 1, 2009 from the corresponding PCT/GB2008/001790.

ENTERTAINMENT SYSTEM AND METHOD

The present invention relates to an entertainment system and method.

Since their conception, remotely controlled toys such as remotely controlled cars and aircraft have been perennially popular. Recently, additional functionality has been added to these toys with the progressive miniaturisation of electronic devices. Therefore, devices such as video cameras have begun to be included at relatively low cost on such toys. The captured video images are often sent from a video camera attached to the toy to a display on the remote controller or to a headset that a user may wear. Such toys are often called "spy toys" as they enable a user to spy on their friends by driving the vehicle into the vicinity of the friends and using the video camera to spy on them. Additionally, these toys may comprise other features such as microphones to capture audio.

However, the video cameras fitted to these remotely controlled toys are often of relatively low resolution due to bandwidth restraints and manufacturing costs. Furthermore, a user may soon tire of spying on their friends and may struggle to think of other possible uses for the video camera. They may thus resort to merely using the locomotive aspects of the remotely controlled toy and neglect to fully use the additional aspects provided with the toy such as the video camera.

In the different technical field of image recognition, systems that utilise augmented reality to enhance a user's interaction with captured video images are becoming more widely known. In these systems, image features are detected within the captured images and designated as an image feature. The system may then generate a computer generated image in dependence upon the designated image feature and superimpose the generated image on the captured image. The captured video images can thus be said to be augmented with computer generated images. For example, such systems are used for TV coverage of live action sports where the position of a ball may be tracked and reproduced as a yellow line superimposed on the video footage that indicates the path the ball has taken. Additionally, the superposition of computer generated images onto video images comprising augmented reality markers that indicate where an image feature should be generated are known. However, such applications are relatively esoteric and tend to be limited in their functionality. Relevant prior art is "Virtual Bounds: a teleoperated mixed reality", K. Ponto, F. Kuester, R, Nideffer and S. Penny, Virtual Reality (2006) 10, pgs 41-47.

The present invention seeks to alleviate or mitigate the above problems.

Various respective aspects and features of the invention are defined in the appended claims.

Advantageously, an extremely versatile and entertaining entertainment system, device and method are provided such that a user is unlikely to get bored with a remotely controlled toy. For example, where the remotely controlled toy is a remotely controlled car, a user can play a racing game on the entertainment device using their remotely controlled car as the featured car within the game and race around a virtual race track in their own living room.

Preferably, the control data comprises attribute control data that relates to an attribute associated with the virtual image feature; and the processing means is operable to generate the to attribute control data in dependence upon the attribute associated with the virtual image feature.

Therefore, an aspect of a game played on the entertainment device may be simulated using the remotely controlled toy. For example, where the remotely controlled toy is, for example, a remotely controlled car, driving over a virtual bed of nails could cause the physical car to behave erratically and the affected wheel prevented from turning.

Embodiments of the present invention will now be described by way of example with reference to the accompanying drawings, in which.

An entertainment system and method is disclosed. In the following description, a number of specific details are presented in order to provide a thorough understanding of embodiments of the present invention. It will be apparent however to a person skilled in the art that these specific details need not be employed to practice the present invention. Conversely, specific details known to the person skilled in the art are omitted for the purposes of clarity in presenting the embodiments.

Figure 1A:
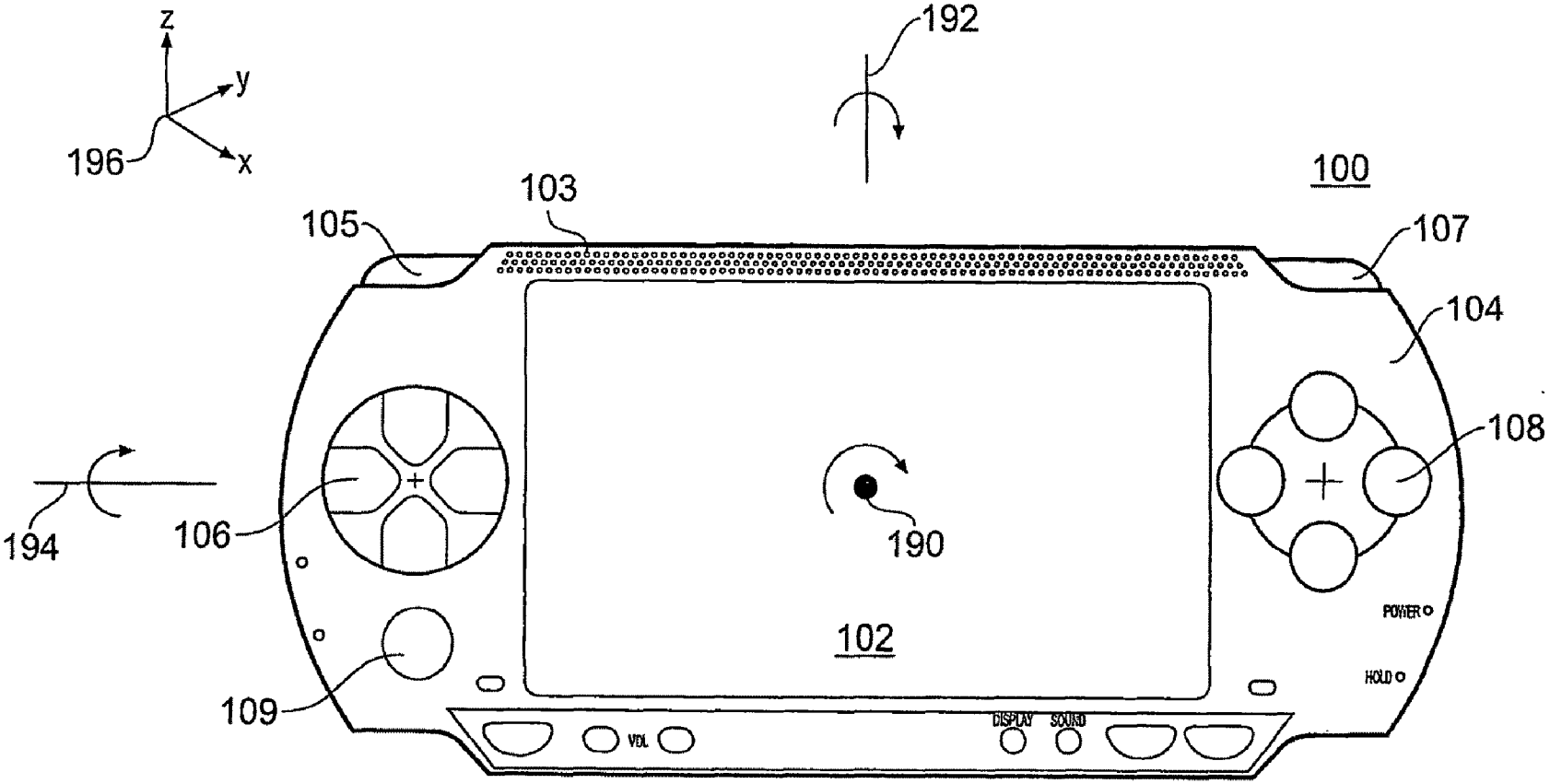
FIG. 1A is a front view of an entertainment device in accordance with an embodiment of the present invention.

Referring to FIG. 1A, in an embodiment of the present invention a Sony® PlayStation Portable® (PSP) entertainment device acts as an entertainment device 100. The PSP body 104 comprises, inter alia, a left shoulder input button 105, a left joypad 106, a right shoulder input button 107, a right joypad 108, and an analogue input device 109. These are used to interface with software running on the PSP. In addition, the PSP comprises an integral display 102 and a speaker 103.

Optionally, the entertainment device may be operably connected to a motion sensor operable to detect motion about three rotational axes 190, 192 and 194 and three translational axes 196. Such motion sensing techniques based on accelerometers are known in the art and are used in games controllers such as the SIXAXIS® user input device manufactured by Sony Computer Entertainment Europe® or the Wii Remote® user input device manufactured by Nintendo®. For example, the motion sensor could connect to the entertainment device via the USB connector 125 such that the motion sensor is both electrically and mechanically coupled to the entertainment device. Alternatively, the entertainment device comprises motion sensing means operable to act as the motion sensor. The detected motion is used to generate control commands for controlling the remotely controlled toy.

In a further alternative arrangement the entertainment device comprises (or is connected to) a camera, so that motion of the entertainment device can be detected by detecting inter-image motion between images captured by the camera. Such an arrangement is sometimes referred to as "optical flow" motion detection.

These alternative arrangements may be combined.

Accordingly, the entertainment device provides one or more ways of accepting a user input representing desired direction and speed controls to be applied to a remotely controlled toy. These are: manual controls via the joy-pads and/or analogue input device, motion detection using a SIXAXIS or similar input arrangement, and/or motion detection using an optical flow detection arrangement. The manual controls and motion detection controls may coexist as alternatives in a single device. The different types of motion detection may be used singly or may be combined so as to reinforce an accurate detection of motion.

More details of the use of these controls will be given below.

Figure 1B:
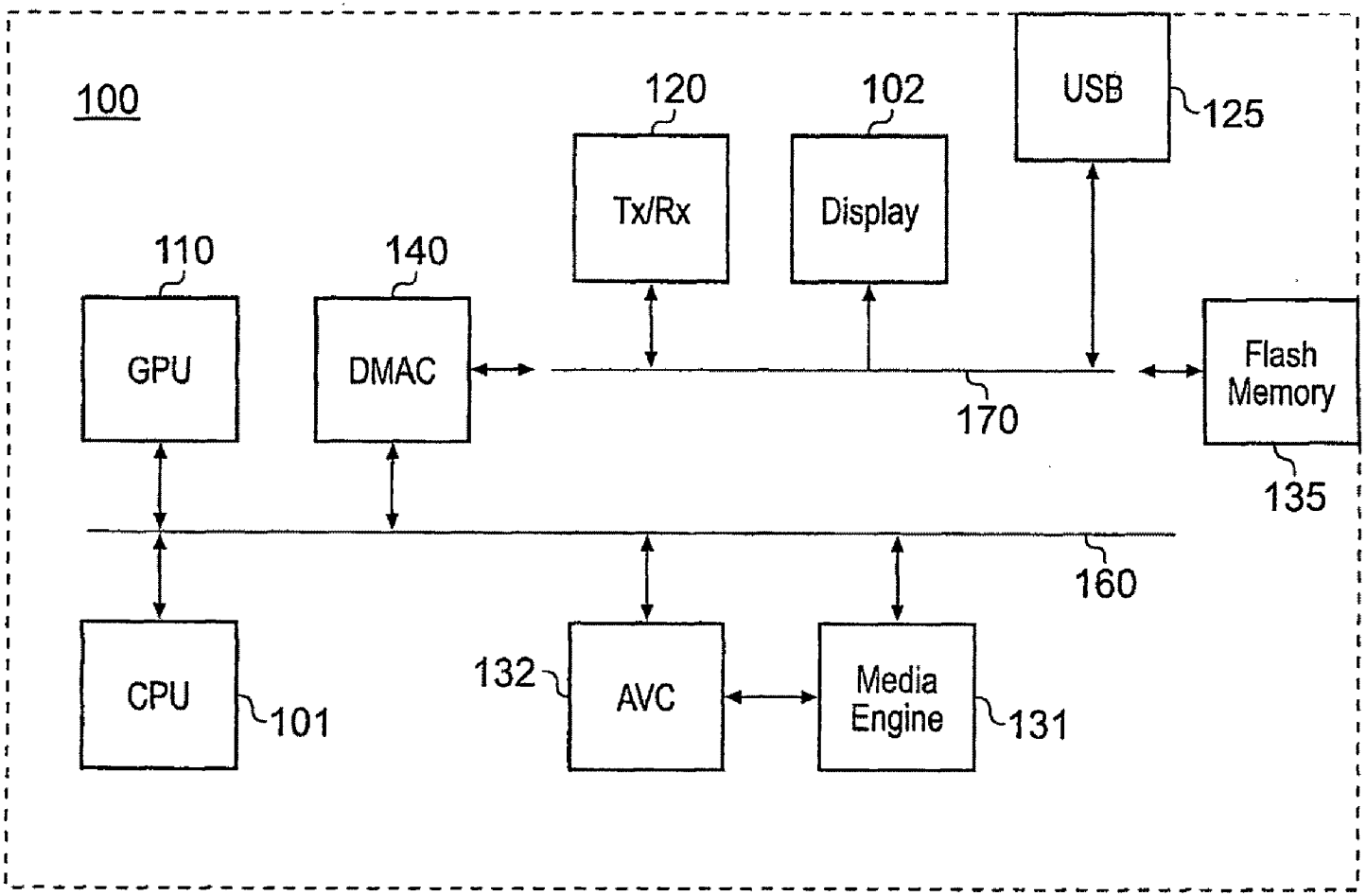
FIG. 1B is a schematic view of an entertainment device in accordance with an embodiment of the present invention.
Figure 1C:
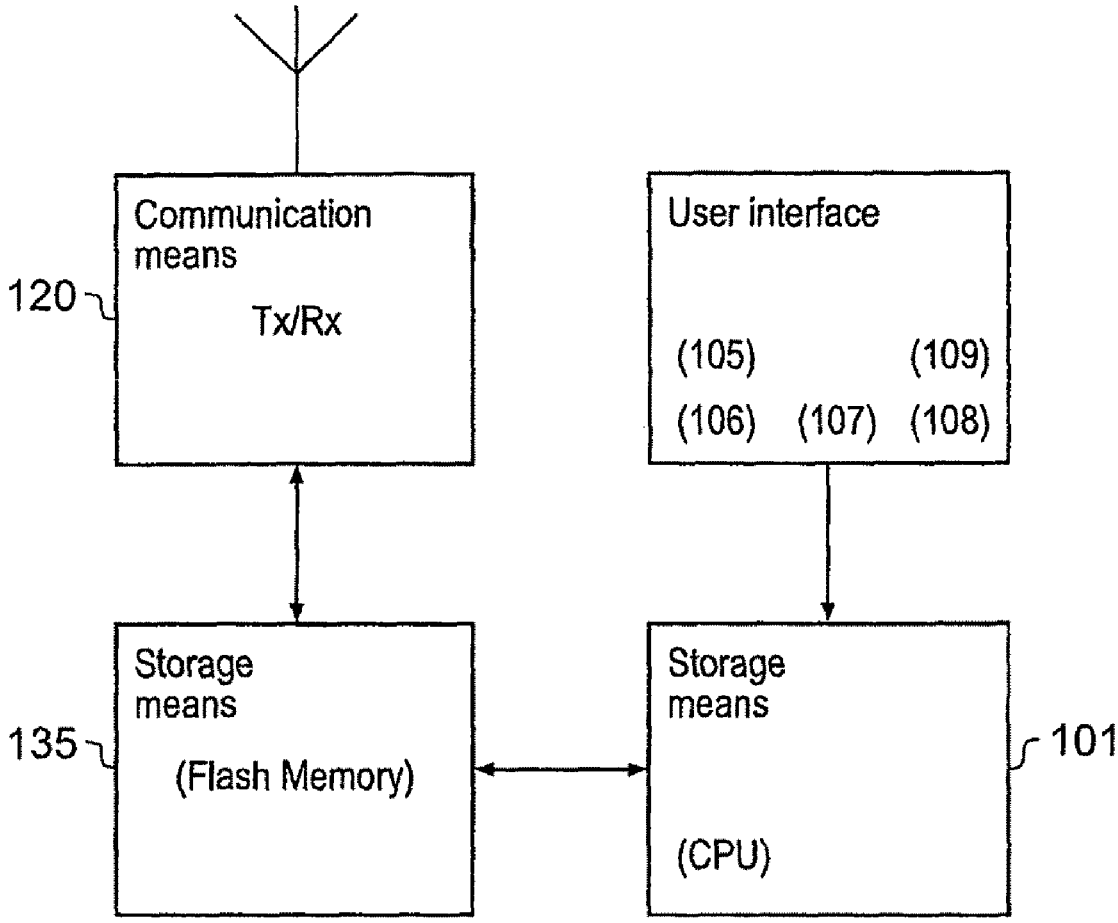
FIG. 1C is a schematic view of a functional arrangement of elements of an entertainment device in accordance with an embodiment of the present invention.

Referring now also to FIG. 1B, a summary schematic diagram of a PSP acting as the to entertainment device 100 according to an embodiment of the invention is provided. The PSP comprises a central processing unit (CPU) 101, a graphics processing unit (GPU) 110 for polygon rendering and the like, a media engine 131 and an audio/video processor (AVC) 132 for image rendering, video and audio playback and the like, and a direct memory access controller (DMAC) 140, linked by a common bus 160. The DMAC 140 also links to an external bus 170 through which inputs and outputs are communicated, including with a wireless communication means (Tx/Rx) 120, a USB connector 125, a flash memory stick interface 135 that can act as a storage for the device, and to the integral display 102. FIG. 1C shows a schematic view of a subset of these elements, identifying their roles in embodiments of the present invention. All operate under software control, e.g. from disc or network (e.g. wireless Internet connection).

According to an embodiment of the present invention, the entertainment device 100 is operable to act as a remote controller for a remotely controlled toy. In doing so, remote control data is transmitted to the toy using the communication means 120. In the embodiment described below, the remotely controlled toy is a remotely controlled car although it will be appreciated that the remotely controlled toy could be any remotely controlled toy such as a motorbike, truck, helicopter, boat, submarine, hovercraft, robot, dinosaur or other suitable remotely controlled toy or remotely controlled vehicle.

For example, the left joypad 106 could be used to steer the remotely controlled car and the right joypad 108 could be used to control the speed of the remotely controlled car. Alternatively, the analogue input device 109 may be used to control the car (with a left-right motion of the input device denoting direction and a forward-backward motion of the device denoting forward and reverse speed and braking) although any suitable input device could be used. Optionally, a user can control the remotely controlled toy by rotating or translating the entertainment device such that the resultant motion is detected by the motion sensor and/or the optical flow detection arrangement. The CPU 101 then generates control signals to control the car in dependence upon the detected motion. For example, in the case of controlling a remotely controlled car, the user could rotate the entertainment device about an axis 190 normal to the integral display 102 to steer the car left or right and could tip the entertainment device about an axis 194 parallel to the centre of the longer side of the entertainment device to accelerate or brake. It will be appreciated by the skilled person that CPU 101 could generate other different control signals suitable for controlling the remotely controlled toy in dependence upon the input from the motion sensor.

Additionally, other control features may be provided. For example, the left shoulder button 105 could be used to change down a gear and the right shoulder button 107 could be used to change up a gear although it will be appreciated that the operation of the shoulder button is not limited to changing gear but could be used to control other functions of the car or others features related to a game. In the car, the gear change can be implemented either with physical gears or by controlling the speed at which the motor or motors are allowed to turn so as to provide a virtual gear box. Furthermore, buttons of the left or right joypad that are not used to control the motion of the car may be used to operate other functions such as sounding a horn or providing a "nitro boost". A "nitro boost" is a feature commonly found in racing games where the speed of the car is boosted for a short amount of time thus mimicking the effect of injecting nitrous oxide into a real car engine. In a remote controlled car, this can be achieved by increasing the drive voltage of the car's motor for a short amount of time.

A remotely controlled car according to an embodiment of the present invention will now be described with reference to FIG. 2.

Figure 2:
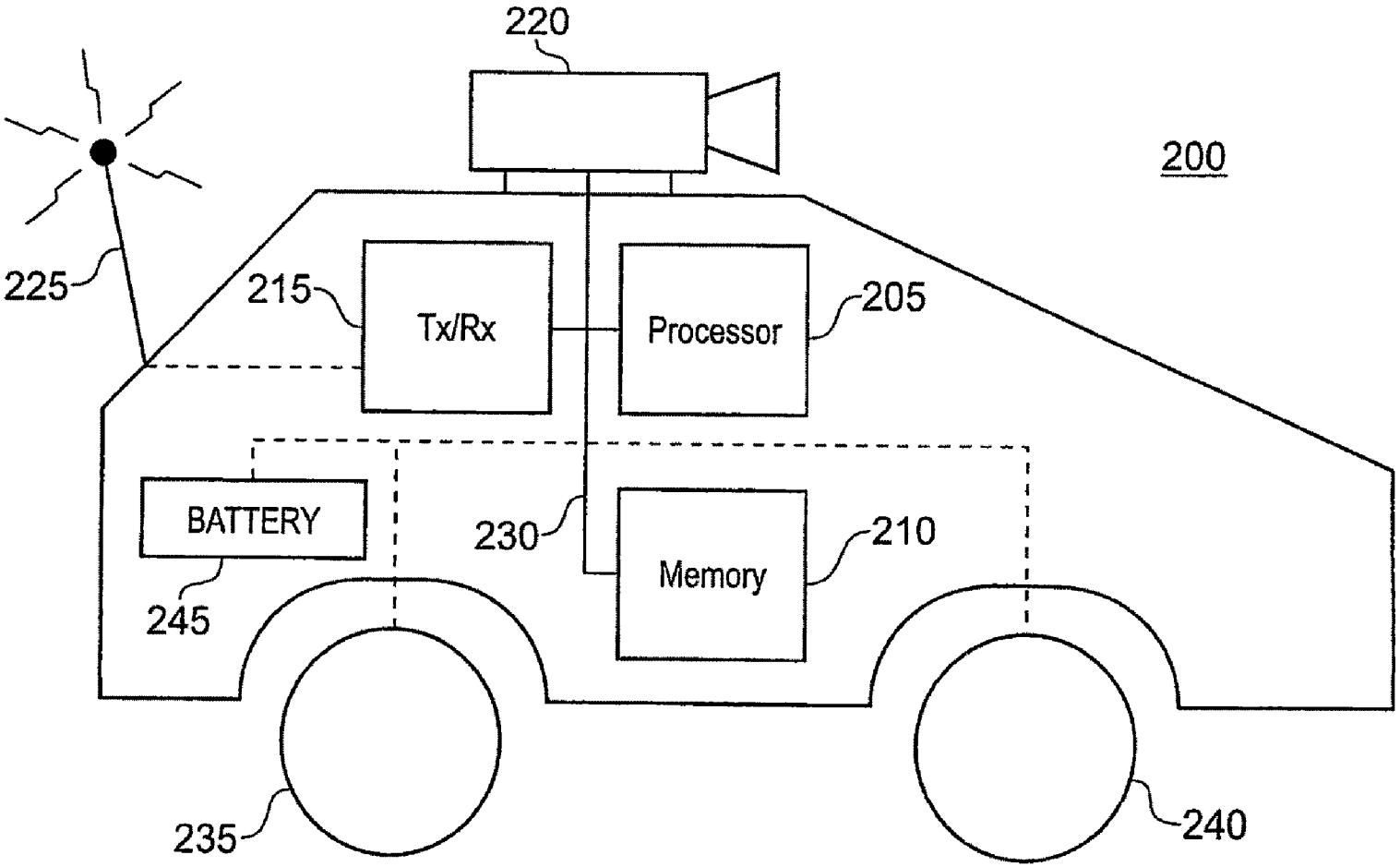
FIG. 2 is a schematic view of a remotely controlled toy in accordance with an embodiment of the present invention.

FIG. 2 shows a schematic view of a remotely controlled car 100 according to an embodiment of the present invention. In addition to the features typically found in a remotely controlled car, the remotely controlled car 100 comprises: a processor 205 operable to act as a controller by generating vehicle control commands that relate to control of the car 100 and to modify the behaviour of the car in dependence on control data received from the entertainment device 100; a memory 210 operable to store data such as video data, audio data, vehicle control data and the like; transmitting/receiving means 215 (Tx/Rx) operable to communicate using a communication link 225 with a remote controller such as the entertainment device 100; a video camera 220 operable to capture video images of the environment in which the car is situated; vehicle propelling means 235; vehicle steering means 240; a battery 245 operable to provide power to any or all of the processor 205, the memory 210, the transmitting receiving means 215, the video camera 220, the vehicle propelling means 235, and the vehicle steering means 240; and a communication/power bus 230. The transmitting/receiving means (Tx/Rx) 214, the processor 205 and the memory 210, the vehicle propelling means 235, the vehicle steering means 240, and the battery 245 are all operably connected via the communication/power bus 230. Preferably, the battery 245 is rechargeable although it will be appreciated that other power sources could be used to power the car 200 such as fuel cells, photovoltaic cells, disposable batteries, an internal combustion engine and the like. These power sources could be combined so as to respectively power different operative features of the car 200.

Although the embodiment described above shows a rear-wheel drive car, it will appreciated that the car 200 could also be front-wheel drive or four-wheel drive. Optionally, the vehicle steering means 240 is operable to control the wheels of the car 220 so as to employ four wheel steering—similar to that found in so-called monster trucks—where all four wheels are used steer the vehicle.

Additionally, each wheel can be controlled independently (for example by selective braking and/or by controlling the power output of each drive motor) in accordance with control signals received from the entertainment device 100 or by the processor 205. Furthermore, one or more of the wheels can be operably coupled to a rotation detector (not shown) operable to detect the number of revolutions per second that each wheel performs. The signals generated by the rotation detector are sent to the processor 105 via the communication bus 230. The processor 205 can then generate speed data that relates to the speed of the car in dependence upon the data received from the rotation detector. The data generated by the rotation detector can also be used when carrying out dead reckoning as will be described later below. Optionally, the signals generated by the rotation detector can be transmitted to the entertainment device 100 via the communication link 225.

According to an embodiment of the present invention, the remotely controlled car 200 additionally comprises independent suspension (not shown) operably coupled to suspension position sensors (not shown) operable to detect the loading on the suspension system of each wheel. These can be used to detect whether the car 200 is airborne (for example during a jump) or whether the car 200 is performing a wheelie (where only the front wheels leave the ground). For example, if the suspension position sensors detect that all four wheels are un-loaded, then the processor 205 is operable to generate a signal indicating that the car is in the air (or perhaps upside down). This signal is then sent to the entertainment device 100 using the communication link 225. The received signal can then be used within a driving game to generate a score within the game or to generate game statistics.

For example, a record of the length of time the car spends in the air during a jump could be stored and a table compiled indicating the longest time spent airborne. Additionally, the distance across the ground that the car has traveled whilst in the air can be calculated by the CPU 101 in dependence upon the data generated by the rotation detector (which gives the speed of the car 200 at the time at which the car 200 first became airborne) and the time spent in the air as indicated by the data generated by the suspension position sensors. The distance traveled and other game statistics can then be displayed to the user on the integral display 102 or used to generate a game score. Optionally, a game score may be generated in dependence upon the number of jumps performed by the vehicle within a predetermined time period.

It will be appreciated that the independent control of each wheel can also be used to replicate features found on full-size road cars such as active suspension, anti-lock braking system (ABS), cadence braking, traction control, variable steering, stability control, power distribution between the wheels, differing gearbox ratios, nitrous oxide injection and the like.

Additionally, the car 200 may comprise an inductive charging means operable to charge the battery 245 by means of inductive coupling with a charging station. Optionally, the battery 245 may be charged by using a suitable rectifier and electrically connecting the battery to a charging source such as the secondary coil of a transformer whose primary coil is connected to the national grid electricity supply.

Optionally, the car 200 does not comprise the memory 210 so as to save on manufacturing costs, with the processor perhaps being in the form of an application specific integrated circuit. In such a case the car would simply receive and implement directional instructions from the entertainment device and would capture and forward image and/or sound signals to the entertainment device.

Optionally, the processor is operable to compress the captured video images using a suitable video compression standard such as the Motion Pictures Expert Group 4 data format (MPEG4), the International Telecommunication Union Telecommunication standard H.263 video, the Audio Video Standard (AVS) and the like so as to reduce the bandwidth requirements when transmitting the video images (using the Tx/RX 215 and the communication means 120) to the entertainment device 100.

Additionally, the car may optionally comprise any or all of: a horn; an accelerometer operable to detect an impact with the car; a bumper or buffer operably coupled to a switch to detect an impact between the car and another object; audio reproduction means such as a loudspeaker; a microphone; lights; a projectile firing device operable to fire projectiles; a battery charge detection means operable to detect the amount of charge in a battery used to power the remotely controlled car 200; and a distance measuring means operable to detect the distance between the car and another object. The operation of each of these and their interaction with the entertainment device 100 will be described later in more detail below.

According to an embodiment of the present invention, the features of the car as to described above—in particular those which relate to the actual physical performance of the car such as steering, braking and suspension—can be customised by the user or be set in accordance with pre-programmed settings. These settings can be user selected or be defined by the software being used to execute a game. According to an embodiment of the present invention, these settings may comprise any one of:

- a standard mode: an average of all the possible combinations of car set up although this mode may be customised by the user using the entertainment device 100;
- a rally sports mode: gear box set so as to provide rapid acceleration, suspension set hard, ABS set low, traction control set low and stability control set high so as to mimic the performance of a full-size rally car;
- an off-road mode: high torque (i.e. low gear ratios), active suspension set soft, ABS set high, traction control set high, active control set so as to provide even power distribution to all four wheels, stability control set high and four-wheel steering so as to give the user maximum control of the car 200 when driving over uneven surfaces;
- an F1 sports mode: high ratio manual gear box, active suspension set hard, ABS set high, traction control set high, active drive with 100-0 rear/front power distribution but with analogue changes in power distribution between the front and rear being dependant on the turning radius, and stability control set high so as to give maximum grip and speed when driving on a flat surface; and
- a nitro boost mode: as described above, the voltage supplied to the drive motors is increased for a short amount of time so as to create a noticeable increase in speed to although this mode is not available all the time.

In the setting described above: "suspension set hard" means that the suspension system has a high spring rate (scaled appropriately for the vehicle size); "suspension set soft" means that the suspension system has a low spring rate (scaled appropriately for the vehicle size); "high" means that the degree of computer assisted control of that system by the entertainment device 100 and/or the car 200 is set so that control signals generated by either the entertainment device 100 and/or the car 200 in response to systems monitoring signals generated by those systems (i.e. traction control, ABS and the like) has a substantial effect on the driving behaviour of the car; and "low" means that the entertainment device and/or the car 200 are set up so that the motion of the car is largely dictated by the mechanical properties of the systems rather than computer assisted control.

Figure 3:
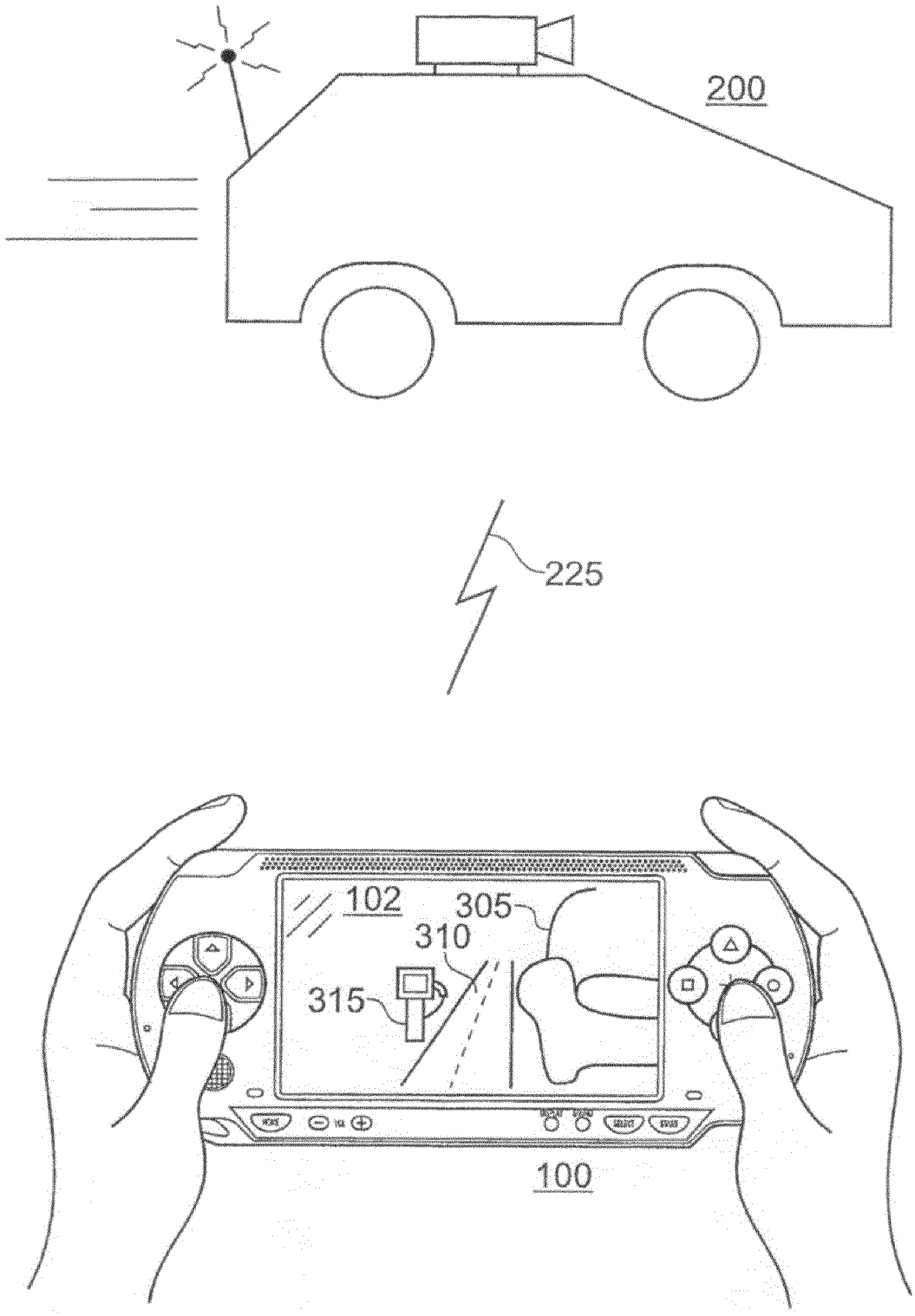
FIG. 3 is a schematic view of an interaction between a remotely controlled toy and an entertainment device in accordance with an embodiment of the present invention.

FIG. 3 shows a schematic representation of the entertainment device 100 to communicating with the remotely controlled car 200. Here, the car 200 captures video images of the environment in which the car is situated using the video camera 220 and transmits the video images using the transmitting/receiving means 215 to the entertainment device 100. For example, the environment in which the car is situated could comprise objects such as a sofa 305, other household objects or architectural features such as doors or stairs. Alternatively, if the car is to be used outside, the environment may comprise trees, plants, garden gnomes and the like.

The images are then rendered by the entertainment device 100 on the integral display 102. Therefore, a user may control the car 200 so as to spy on their friends or build obstacles and view live video from the video camera 220 of the car 200 negotiating those obstacles. Additionally, the entertainment device is operable to store the video images received via the communication link from the remotely controlled car on the storage 135. The user may then upload the stored video images to a website of their choice using a suitable communication interface such as the wireless communication means 120. Typically, the wireless communication means 120 is in accordance with the IEEE 802.11 (WiFi) standard although any other suitable wireless communication means could be used.

Optionally, where the car 200 comprises the sound reproduction means and/or the microphone, sound can also be captured and recorded by the entertainment device 100. Furthermore, a user may send music or other audio to the car via the communication link 225 to be reproduced using the audio reproduction means. For example, a user may choose to use the entertainment device 100 to transmit their favorite piece of music or download an audio track that is a recording of the engine sound of a particular car of their choice (e.g. a Ferrari, Ford GT40, Austin Mini, 2CV, Trabant and the like) to the car 200 where it would then be reproduced using the audio reproduction means. Optionally, the car 220 may be sold or supplied with preloaded audio data stored in the memory 210 such as music or sound effects such as engine noise. Therefore, the audio reproduction means can reproduce the engine sound of a real car thus lending an authentic feel to the game experience.

Typically, the audio data is transmitted from the entertainment device 100 to the car 200 in the Motion Pictures Expert Group 1 level 3 data format (MP3) although any other suitable compressed or uncompressed audio data format may be used. Where the car 200 additionally comprises a horn, the entertainment device can send a command to the car to honk the horn or can recreate the sound of a honk using the audio reproduction means. For example, a user could drive the car 200 into another room and honk the horn, thus startling the occupants of that room.

Optionally, the car 200 comprises a "silent running mode" in which the sound produced by the car is reduced below that of a normal operating mode. For example, the audio reproduction means can be set so that no audio is output and the CPU 101 can generate control signals that restrict the speed of the car below a predetermined threshold so as to limit noise produced by the vehicle propelling means. Therefore, for example, the silent running mode assists a user in driving their car so as to spy on their friends or to add to the element of surprise when honking the horn to startle the occupants of a room as described above.

If the car 200 is to be used for a racing game, the integral display 102 of the entertainment device 100 is operable to display features commonly known in racing games such as a speedometer, a tachometer (rev. counter), current gear together with a prompt about when to change gear, car setting (e.g. rally mode, F1 mode, off-road mode and the like as described with respect to the car settings above) and the like. Additionally, the integral display may display, in response to control signals generated by the CPU 101, information that relates to the signal strength of the communication link 225, the charge stored in the battery 245, the current voltage being used to drive the car's vehicle propelling means 235 so as to indicate when "nitro boost" can be used within the game, brake pressure and the like although it will be appreciated that the integral display 102 could be used to display any relevant feature of the game.

According to an embodiment of the present invention, the entertainment device 100 is operable to communicate with the remotely controlled car 200 in an augmented reality game play mode. The augmented reality game play mode is one in which the entertainment device 100 is operable to detect a (possibly predetermined) real environment feature or features within the real environment in dependence upon data received from the car 200 and to replace or augment the detected feature(s) with computer-generated image material. This is handled by the CPU 101 and GPU 110 acting on video data received by the device 100. The entertainment device 100 then generates a combined display of the captured video images and the computer generated image material such that the computer generated image material is arranged with respect to the video images so as to correspond to the physical position of the detected image feature within the real environment.

Therefore, for example, the car 200 could be seen to be driving along a virtual reality race track 310 (a computer generated feature) and past a virtual reality petrol pump 315 (another computer generated feature) with these virtual features being displayed such that the to real environment in which the car is situated (e.g. the sofa 305) is also visible, and the virtual reality race track curves around the sofa so that when the user follows the race track, the car does not hit the sofa. Additionally, the augmented reality features may be used to add game functionality. Optionally, in addition to the augmented reality features, a user may use other real objects such as physical race track, jumps, obstacles and the like to create their own gaming scenario.

Techniques for achieving this will now be described, and the augmented reality game play mode will now be described in more detail with reference to FIGS. 4 and 5.

Figure 4:
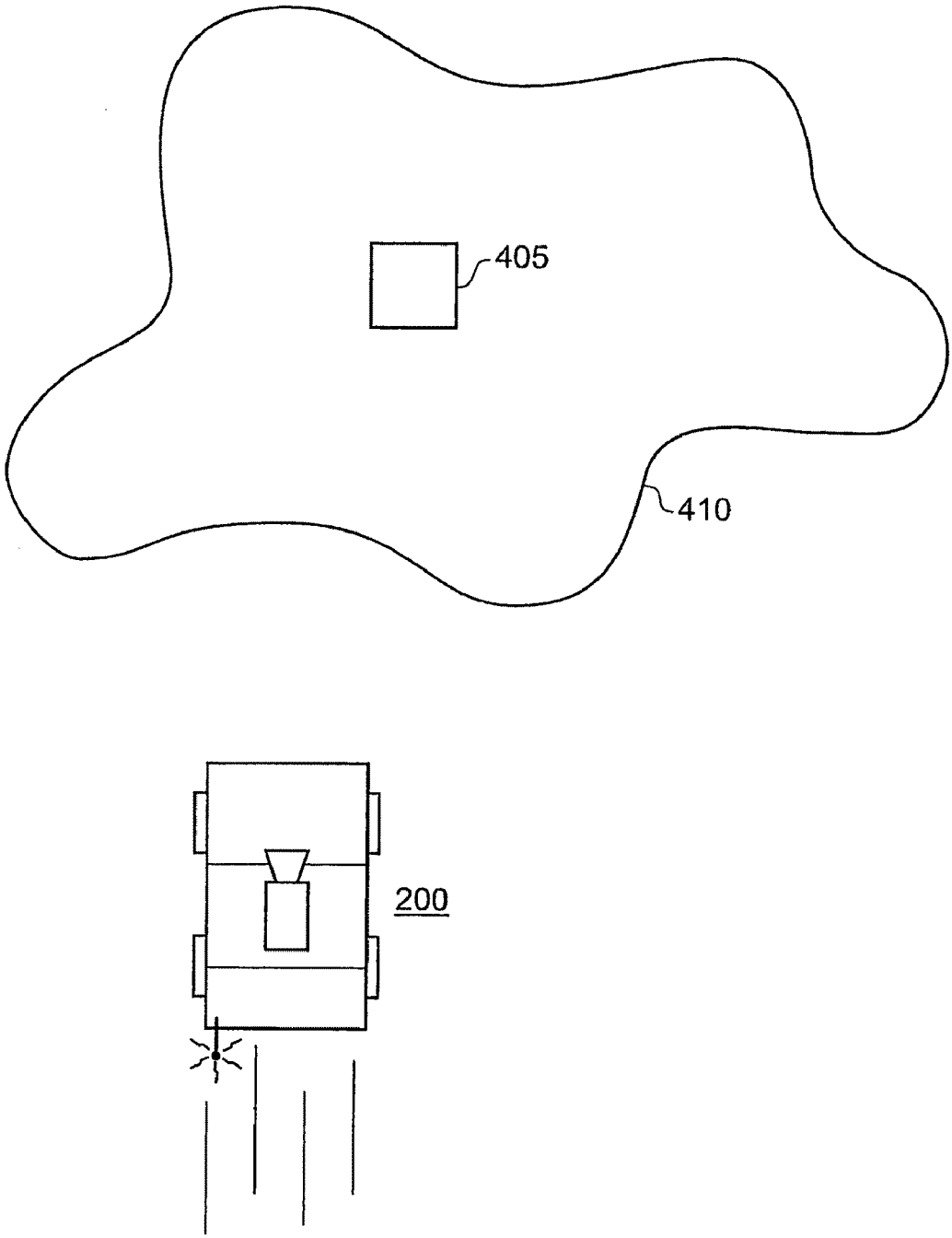
FIG. 4 is a schematic view of an augmented reality zone in accordance with an embodiment of the present invention.

FIG. 4 shows a schematic representation of the remotely controlled car 200 interacting with an augmented reality zone 410. The augmented reality zone 410 is defined with respect to an augmented reality marker (AR marker) 405. In an embodiment of the present invention, the AR marker may be any object that is relatively easy to automatically distinguish within the captured video images using known image recognition methods although the AR marker could be an radio frequency (RF) transponder that is detected using known RF techniques. The use of an RF AR marker will be described in more detail later.

Where the AR marker is detected using image recognition methods, the AR marker may be, for example, a three dimensional object such as a cube or a cylinder or it may be a two dimensional marker such as a square or a circle. Typically, the AR marker comprises an easily distinguishable pattern such as a black and white square although other methods may be used for marker recognition such as using a particular colour or pattern of colours and the like. Preferably, the AR marker comprises a "fractal" marker pattern known in the field of augmented reality markers.

A "fractal marker" is an AR marker that has as its pattern a group of smaller markers. Each of the smaller markers has its own pattern that may act as a marker. Therefore, if only part of the whole fractal marker is visible within an image captured by the video camera, the fractal marker can still be used to provide augmented reality as a complete image of some of the smaller markers can still be captured by the video camera. Furthermore, when the camera is so close to the fractal marker that the border of the whole fractal marker is no longer visible within the field of view of the video camera, the marker can still allow the AR system to function effectively. In the case where the marker is two-dimensional, the marker may be self-adhesive so as to enable a user to stick it to objects within the environment such as a side of the sofa 305.

Typically, the CPU 101 of the entertainment device 100 detects the AR marker within the video images by using image recognition techniques known in the art. However, it will be appreciated that the processor 205 of the car 200 could detect the marker within the captured video images and generate (using those known techniques) image marker position data that relates to the position of the marker within the images. The image marker position data could then be transmitted to the entertainment device 100 via the communication link using the transmitting/receiving means (Tx/Rx) 215. Accordingly, the image processing tasks needed to detect the AR marker could take place at the entertainment device, at the car, or could even be split between the two.

Once the AR marker 405 has been detected the CPU 101 is operable to detect the distance between the car 200 and the AR marker 405 in dependence upon the percentage of the displayed image that is occupied by the AR marker 405 again, a known image recognition technique. The CPU 101 is also operable to define the augmented reality zone (AR zone) 410 as representing a region in the real environment surrounding the (real) position of the AR marker in the car's real environment.

When the car 200 is within the real area that corresponds to the AR zone 410, the functionality of the entertainment device 100 interacting with the remotely controlled car 200 is extended or altered. The following example of the augmented reality game mode describes a racing game although it will be appreciated that any other suitable game could be used.

In an embodiment of the present invention, the augmented reality zone 410 defines, for example, a virtual bed of nails or an oil slick. If the car 200 drives over the bed of nails or over the oil slick (i.e. enters the AR zone 410) the entertainment device 100 is operable to send a command to the car 200 so that the driving performance of the car 200 will be affected. Therefore, the car 200 can be raced around a user's house whilst game effects commonly associated with virtual racing games previously solely executed on an entertainment device may be realised within a real environment by a remotely controlled toy or vehicle such as the remotely controlled car 200.

In the example of the bed of nails given above, the entertainment device 100 could send a signal to the car 100 to control the vehicle propelling means 235 in such a way as to give the impression that a tyre has been punctured, e.g. by stopping the affected wheel or wheels from turning. In the oil slick example given above, the entertainment device could send a command to the car 200 to be executed by the processor 205 such that the car 200 would swerve and spin or a command to disable any user input commands by the user, thus mimicking the effects of driving across a real oil slick. Optionally, when the car leaves the augmented reality zone 410, these effects cease. However, this need not necessarily be the case. In the case of the virtual bed of nails, the affected tyre could remain immobilised for a particular amount of time or until another game action takes place. Although a virtual oil slick and a virtual bed of nails have been described with reference to a remotely controlled car, it will be appreciated that other effects such as sand, snow, ice and the like and any other effects appropriate to the remotely controlled toy or the game may be simulated.

It will be appreciated that processing tasks needed for this functionality could be implemented at the entertainment device, at the car, or as a split between both. The basic steps are: to detect the AR marker in captured video, to define the AR zone, to detect whether the car is in the AR zone, to generate control instructions to alter the car's behaviour or response within the AR zone and to respond to those control instructions. Only the last of these (physically responding to the instructions) needs to be implemented by the car. Of the rest, the tasks can be carried out by the car or by the entertainment device, with data being shared (as appropriate) between the car and the entertainment device via the wireless link.

Furthermore, it will be appreciated that the use of an AR zone is not limited to controlling the motion of the remotely controlled car and that other behaviours of the car may be modified. For example, with the virtual bed of nails as described above, the entertainment device could generate control signals that cause the audio reproduction means to reproduce the sound of a car tyre bursting and then skidding or squealing. Additionally, other functions and behaviours of the car could be modified such as modifying the sound output by the audio reproduction means, changing the car setting (for example between off-road mode and rally mode), causing the projectile firing means to fire a projectile and the like.

In order to determine whether the car 200 is within the real area that corresponds to the AR zone 410, a variety of different techniques may be employed. Typically, the position of the car with respect to the marker is detected by determining the size of the AR marker 405 within the captured video images using techniques known in the art. Optionally, the position of the car may be tracked using dead reckoning, for example by detecting the number of revolutions of the wheels, or by tracking motion vectors detected within the captured video images by using suitable techniques known in the art. This is typically performed by the CPU 101 of the entertainment device based on data received via the communication link 225 from the car 200, although it will be appreciated that this could be carried out by the processor 205 of the remotely controlled car 200.

Figure 5:
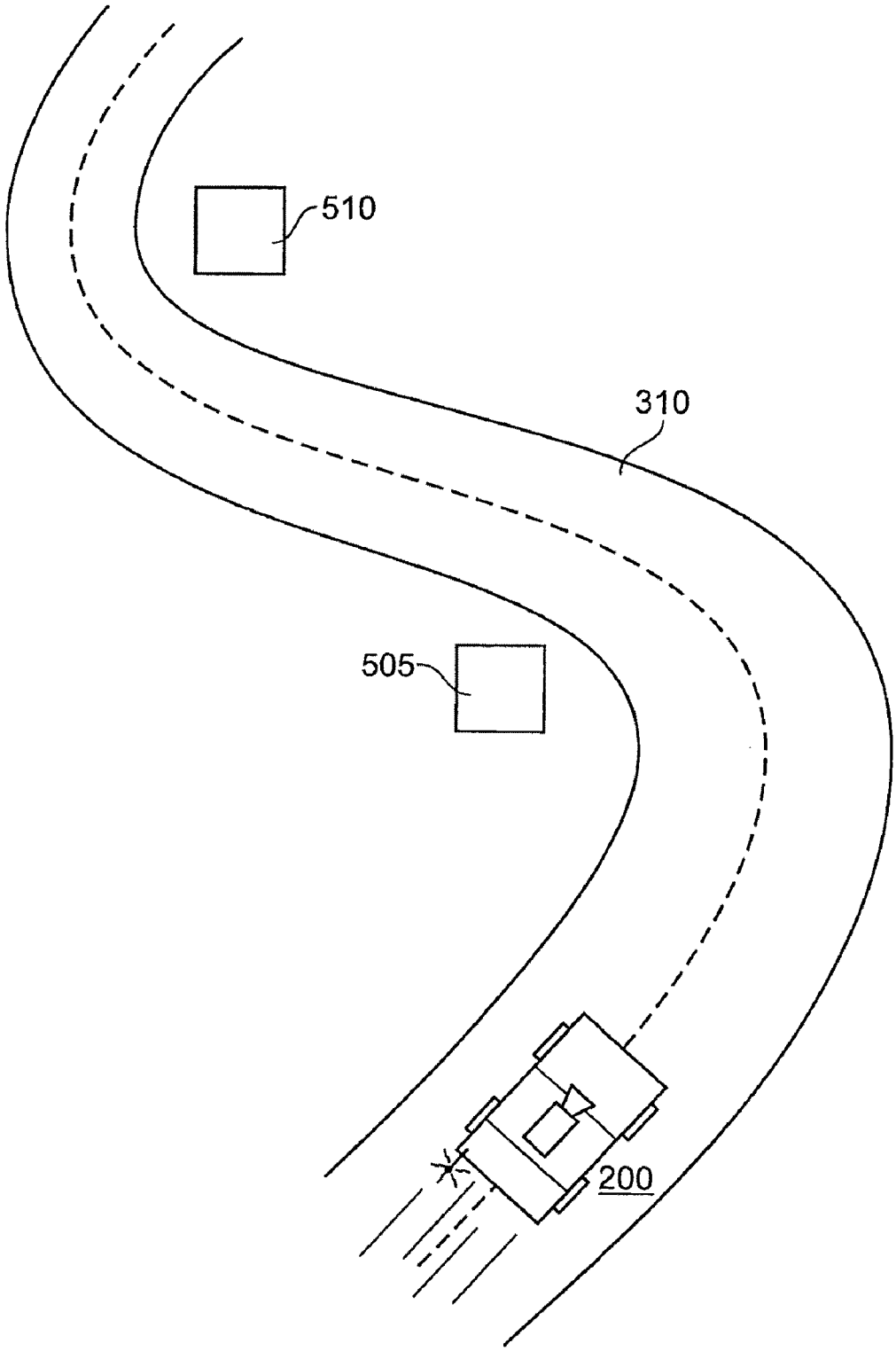
FIG. 5 is a schematic view of a remotely controlled toy interacting with an augmented reality zone in accordance with an embodiment of the present invention.

FIG. 5 shows a schematic representation of the remotely controlled car 200, the virtual race track 310 and two augmented reality markers 505 and 510. Here, the augmented reality markers are used to define the position of the virtual road 310. The CPU 101 detects the position of the AR markers 505 and 510 and generates the virtual road 310 for rendering on the display together with the video images captured by the video camera 220. If a player's car deviates or comes off the track, then the CPU 101 generates a command that is sent to the car 200 that slows the car 200 down (as in a standard screen display-based racing game). Optionally, the CPU 101 can generate commands that simulate the effect of over-steer and under-steer. These are sent to the car 200 via the communication link 225 and the processor 205 of the car 200 then generates control signals that control the vehicle propelling means 235 and the vehicle steering means 240 so as to control the car and simulate the game effect.

Additionally, the markers 505 may be used to augment the game play of a racing game in many different ways. For example, in a time-trial section of a racing game a player might have to drive their car 200 to within a predetermined distance of a particular marker within a certain amount of time or they would have to get between the markers 505 and 510 within a particular amount of time.

In an embodiment of the present invention, a plurality of augmented reality markers may be used to define a course for a player or players to race on. For example, the markers may define the edges of a track or the centre of a track, with curves being inserted between the markers using known curve-drawing techniques. Optionally, the markers may have different marker patterns on them with different attributes being associated with each pattern, the entertainment device altering the control data it generates in response to such attributes. For example, 'lap' markers could be defined which mark the start and finish of the track. Additionally, a 'midway' marker could be used to mark a midpoint of the track. This advantageously means that a user can define their own track layout using the geographical layout of their house with a minimal number of markers.

As an example, a user could decide to start at the coffee table (on which is stuck a 'lap marker'), race under the sofa 305, past a 'midway' marker in the hallway, and then back to the coffee table. Rather than the system creating a virtual track, perhaps in a rally variant of the game any allowable route between the markers could be used, thus allowing the user to try and find the fastest route between the markers. Furthermore, a plurality of different markers could be used to indicate different buildings. Therefore, for example, a user could play a "taxi driver" game in which they have to drive the car 200 to particular markers (buildings) in a predetermined order within a particular amount of time so that they make as much money as possible and thus achieve a high score within the game.

The CPU 101 is optionally operable to generate ad hoc associations between the AR markers detected within the captured video images and other detected image features within the captured video such as a wall clock or coffee table. The CPU 101 can generate position data that relates to the relative position of the car 200 with respect to the AR marker and the designated image feature. These ad hoc associations are stored in the flash memory 135. Therefore, the ad hoc associations can be used to reduce a processing load on the CPU 101 by providing additional position information without the position of the car 200 having to be calculated every video frame. Additionally, for example, the ad hoc associations can be used to define a game action that must be performed within a racing game. For example, a player may gain extra points if they steer their car 200 such that it approaches the AR marker from a particular angle as defined by the ad hoc association.

According to an embodiment of the present invention, the entertainment device 100 is operable to store a database of virtual objects (such as the petrol pump 315) that can be assigned to the AR markers. A list of virtual objects is displayed to a user on the integral display 102 so that the user can then select which virtual object to assign to each AR marker using an input device such as the left or right joy pad (106, 108) or the shoulder buttons 105 and 107. Therefore, a user can design their own game environment by using the AR markers and assigning a virtual object to an AR marker. In this way, a user may also use the entertainment device 100 to assign different functionality to the AR marker 405 or markers and/or define the shape and size of the AR zone 410. For example, the user could assign the "bed-of-nails" to a marker of their choice and define the size of the AR zone around that marker in which the "bed-of-nails" command will take effect.

In order to reduce the likelihood of damage to the car 200 or to other users not participating in the game, in an embodiment of the present invention, 'no entry' AR markers are provided. Typically, these are striped cylinders so that it is easy for the CPU 101 to identify them using video images captured from any viewing direction with respect to the marker although any suitable marker design may be used. On detecting a 'no entry' AR marker, the CPU 101 sends a command using the transmitter/receiver (Tx/Rx) 120 to the car 200 that instructs the car to slow down and stop as it approaches the marker. For example, a 'no entry' AR marker can define an exclusion zone into which the car is prevented from entering. This could be, for example, circle defined with respect to the marker such that the to marker is at the centre of the circle although any suitable shape could be used. The exclusion zone is defined with respect to the no entry marker in a similar way to that described for the augmented reality zone 410 above. Accordingly, although a user may drive the car around the perimeter of the exclusion, the car will be prevented from entering the exclusion zone.

As described above, the CPU 101 is operable to detect the position of the marker with respect to the position of the car. The position of the no entry marker is stored on a storage medium using the storage so that even if the no entry marker is not visible in the images captured by the video camera 220 (for example if the car 200 is reversing), the position of the car 200 with respect to the no entry marker can be determined using dead-reckoning and the like (as described above) so that the car 200 can still be prevented from entering the exclusion zone.

Therefore, for example, by suitable positioning by a user of the 'no entry' markers, the car 200 can be prevented from falling down the stairs, entering into dangerous rooms such as the kitchen, avoiding dangerous objects such as fireplaces, and the like.

TABLE 1

| | Wheel to control | | | | |
|---|---|---|---|---|---|
| Command | Front Left (FL) | Front Right (FR) | Back Left (BL) | Back Right (BR) | Disable user input control? |
| "Swerve right" | Steer right | Steer right | — | — | No |
| "Swerve left" | Steer left | Steer left | — | — | No |
| "Oil slick" | — | — | — | — | Yes |
| "Bed of Nails" | Steer left | Steer left | Brake | — | No |
| "No entry" | — | — | Brake | Brake | Yes |

Table 1 illustrates some of the typical commands that may be generated to control the remotely controlled car 200 in accordance with embodiments of the present invention. It will be appreciated that the examples given in Table 1 are for illustrative purposes in describing embodiments of the invention and are not intended to be limiting. For example, the "bed of nails" command is shown as affecting the back left wheel although it will be appreciated that any one or a combination of the wheels could be affected. Typically, the CPU 101 generates the commands given in the column headed command whilst the control signal relevant to each wheel is sent via the communication link 225 to the car 200.

However, optionally, the CPU 101 may generate the command and then transmit it to the car 200 via the communication link 225. The processor 205 is the operable to generate the control signals necessary to simulate the desired behaviour as detailed in Table 1 below and send the control signals to the vehicle propelling means 235 and the vehicle steering means 240 via the communication bus 230. Each wheel may be independently controllable as described in Table 1 although in order to simplify manufacturing costs, for example, the rear wheels could be the drive wheels and the front wheels could be used to steer. However, it will be apparent to a person skilled in the art that any suitable arrangement may be envisaged as an embodiment of the invention.

Optionally, the memory 210 stores control data relating to the control signals (e.g. as attribute-defining data transmitted from the device 100) necessary to simulate the desired behaviour. In this case the processor 205 generates the wheel control signals in dependence upon the control data stored in the memory 210. Additionally, extra functionality can be added to the remotely controlled car 200 by downloading updated control data (e.g. program code) to the memory 210 from the entertainment device 100 via the communication link 225.

In addition to controlling the car in accordance with augmented reality features of a game, the entertainment device 100 is operable to generate control commands that cause the car to execute pre-programmed manoeuvres such as "donuts" (where the rear wheels of the car are caused to skid and spin thus rotating the rear of the car about the front wheels which remain stationary with the resultant skid mark resembling a donut ring), spin turn, reverse spin turn, spin turn into reverse spin turn, reverse parking, 360 degree spin turn, 540 degree spin turn and the like. In this case, the car performs a pre-programmed manoeuvre when a user presses a button on the entertainment device that is assigned to that manoeuvre. For example, when the user presses the left shoulder button 105, the car could perform a 360 degree spin turn.

Optionally, the pre-programmed manoeuvres can be stored in the memory 210 of the car 200 (acting as an instruction storage) so as to reduce the amount of data that needs to be transmitted from the entertainment device 100 to the car 200 each time the pre-programmed manoeuvre is executed. In this case, the entertainment device 100 generates a command designating which pre-programmed manoeuvre is to be performed when a particular button on the entertainment device 100 is pressed. When this button is pressed by a user, the entertainment device 100 transmits this command to the car 200 via the wireless communication link 225. The processor 205 then retrieves the relevant sequence of control commands relating to predetermined actions from the memory 210 and executes these commands so as to cause the car 200 to perform the relevant pre-programmed manoeuvre.

Additionally, a user may use the entertainment device to record their own sequence of manoeuvres. In this case, the user controls the car 200 in real time and the entertainment device 100 detects which buttons were pressed by the user, in what sequence they were pressed and the relative timing of input with respect to the others in the sequence. The CPU 101 is then operable to generate a sequence of car control commands in dependence upon the detected user input and store this sequence on a storage medium using the flash memory stick interface 135. A user can then assign an input button of their choice (that is not already assigned to controlling the car 200) to this sequence of manoeuvres. Therefore, when the user next presses that button, the entertainment device 100 sends that sequence of control signals to the car 200 and the car 200 performs that sequence of manoeuvres. Alternatively, the entertainment device 100 may store a list of unused input devices or buttons and randomly assign the stored sequence to one of those buttons.

Optionally, the car 200 can detect a sequence of control commands received from the entertainment device 100 using the processor 205 and store this sequence in the memory 210. As described above, when the button that is assigned to this sequence is pressed, the processor 205 retrieves the relevant control commands from the memory 210 and execute that sequence of control commands so as to cause the car to perform the desired sequence.

In this way, a user can program a car 200 with a sequence of commands that corresponds to a complete lap around a virtual race track within the real environment. Therefore, the user can create a so-called "ghost-car" by recording the sequence of manoeuvres needed to drive successfully around the track. A "ghost-car" allows a user to race against themselves by recreating their performance from a different lap. Thus a user can then use a different remotely controlled car to race against themselves. Furthermore, the above described system allows a user to make minor alterations to the path the car takes around the lap so as to reduce the lap time so as to try and create a "perfect" lap. In this case, the additional commands generated by the entertainment device in response to the user's input are concatenated with the sequence of control commands already stored. This feature adds to the challenge to a user when they are racing against the ghost car.

Additionally, the entertainment device is able to store video footage captured by the video camera 220. For example, where the user has selected to enter a "trick recording mode" so as to record a sequence of manoeuvres as described above, the CPU 101 is operable to detect that this mode has been selected by the user and starts capturing video images sent via the communication link 225 from the car 200. The entertainment device 100 then stores the captured video images using the storage 135.

Optionally, the entertainment device 100 is operable to store "snapshot" images generated from the captured video images. For example, during game play, when a user presses a predetermined button on the entertainment device 100, the CPU 101 captures an image from the sequence of video images generated by the video camera 220 and sent from the car 200 to the entertainment device 200 via the communication link 225. The captured snapshot is then stored in the storage 135.

As described above, the entertainment device 100 is operable to record a sequence of manoeuvres and detect the speed and distance traveled by the car 200 in dependence upon the signals generated by the rotation detector. Accordingly, the entertainment device 100 can track the position of the car 200 so as to generate the virtual race track 310 without reference to the AR markers 505 and 510. This will now be described in more detail with reference to FIG. 6.

Figure 6:
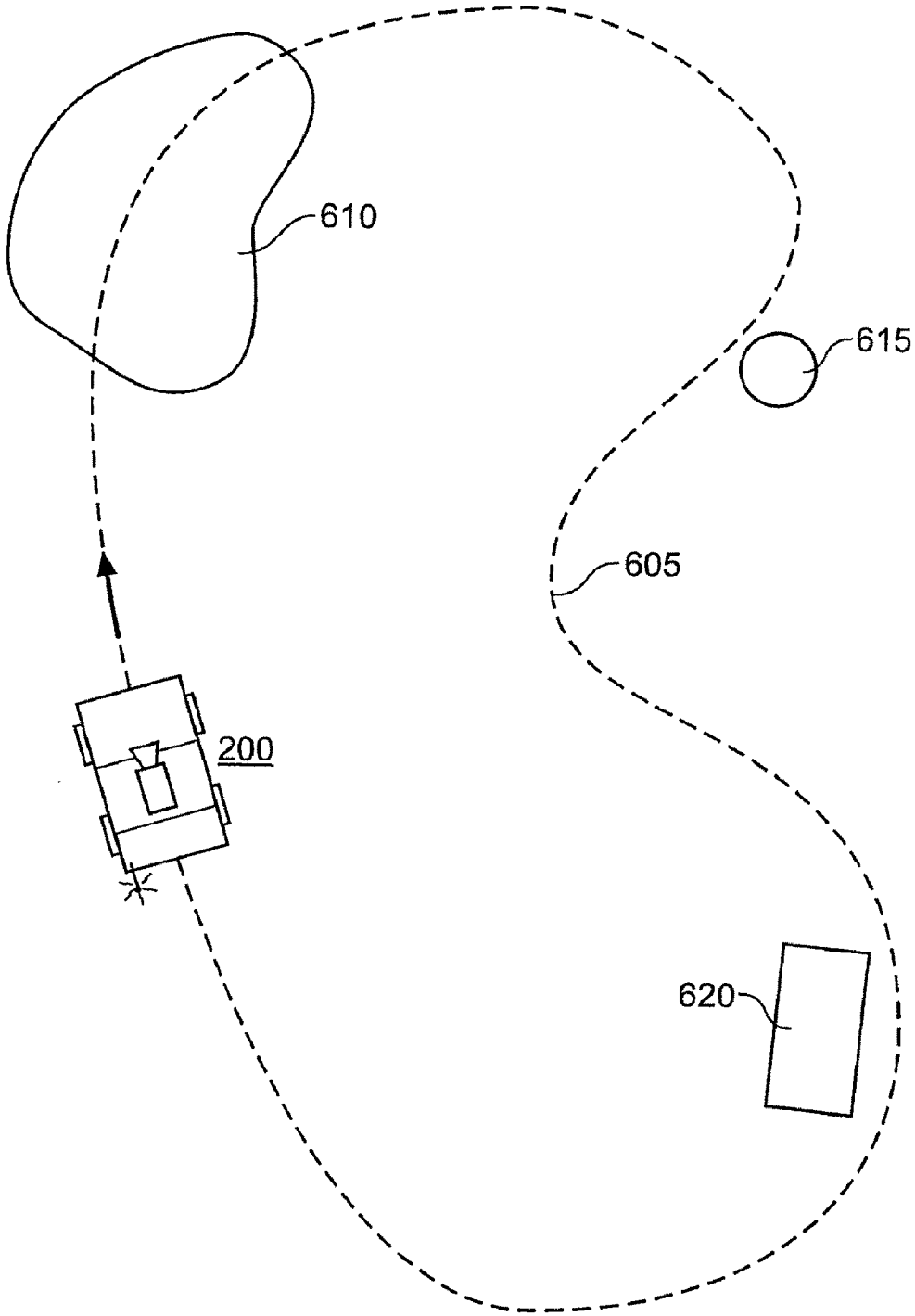
FIG. 6 is a schematic view of an augmented reality zone and augmented reality objects with respect to the position of a remotely controlled toy in accordance with embodiments of the present invention.

FIG. 6 shows a schematic view of an augmented reality zone and augmented reality objects with respect to the position of a remotely controlled toy in accordance with embodiments of the present invention.

As shown in FIG. 6, the entertainment device 100 is operable to detect the path 605 that the car 200 takes within the real environment and generate virtual path data indicative of the path 605 that the car 200 has followed. Typically, this path definition process is carried out by using dead reckoning techniques in dependence upon data generated by the rotation detecting means in combination with the control signals generated in response to user input (as described above) and/or control signals generated by the game. Optionally, known optical flow techniques can be used to track the position of the car 200 with respect to the environment so as to generate the path data. It will be appreciated that these techniques may be combined and that other vehicle tracking means could be employed such as those based on distance measurements carried out using a suitable distance measuring means. Preferably, the position of the car 200 is measured with respect to the starting position of the car rather than a previous known position of the car so as to reduce the deviation of the real position of the car 200 from the detected path 605.

In order to reduce the amount of data generated when tracking the path 605 of the car 200, the CPU 101 is operable to detect the position of the car 200 at predetermined time intervals thus "sampling" the position of the car at various points on the path 605. The CPU 101 is then operable generate the virtual path data by interpolating between the detected positions so as to approximate the actual path 605 followed by the car 200. The CPU 101 is then operable to define a virtual path in dependence upon the virtual path data.

Furthermore, if optical flow techniques are used in addition to dead reckoning, the CPU 101 is operable to compare and detect any differences between virtual path data generated using dead reckoning and the virtual path data that was generated using optical flow techniques. If the difference between the two corresponding virtual paths exceeds a predetermined threshold, the CPU 101 is operable to designate these paths as invalid and not therefore generate a virtual image feature dependent on such paths. This may occur, for example, if the wheels of the car 200 slip on a smooth surface leading to a greater distance being detected than the actual distance traveled by the car 200. Additionally, the CPU 101 may generate an "invalid" path signal that causes the integral display 102 to display a warning to the user and instruct them to restart the path definition process.

Where the difference between the two virtual paths is smaller than the predetermined threshold, the CPU 101 can generate the virtual path to use within the game in dependence upon any of: the virtual path generated using optical flow; the virtual path generated using dead reckoning techniques; and an average of the positions of both paths.

Advantageously, the path 605 may be defined by a user driving the car 200 around the real environment (such as their living room) so as to, for example, create their own track on which to race. Alternatively, the car can be controlled by software executing on the entertainment device 200 so as to drive the car on a predetermined path. By driving the car in the real environment, the virtual path that is generated may be successfully mapped to the real environment.

The virtual path data is then stored on the entertainment device 100 using the flash memory stick interface 135.

Once the virtual path has been defined, the CPU 101 is operable to generate game features and virtual objects that are defined with respect to the generated virtual path. For example, a virtual object 615 such as a petrol pump or a virtual feature 620 such as a building could be generated and rendered within the captured video images so that they appear at positions within the real environment defined with respect to the virtual path that was generated in dependence upon the actual path the car 200 took through the real environment. Additionally, augmented reality zones (e.g. augmented reality zone 610) such as those described above may be defined with respect to the virtual path.

Optionally, the positioning of the virtual objects, features and augmented reality zones with respect to the virtual path may be defined by the user. In this case, the CPU 101 is operable to display on the integral display 102 the virtual path together with a list of virtual objects, features and virtual reality zones. The user may then select which features, objects and zones they wish to use using the user input functions of the entertainment device 100 (e.g. left and right joypad) and position these features as they desire with respect to the previously defined virtual path. Therefore, for example, a user may advantageously define a racing track for them to race their car 200 on as well as defining which virtual objects and augmented reality zones they wish to use. Furthermore, by defining a virtual path and defining the virtual objects, features and zones with respect to the recorded virtual path, a user is free to design their own game as they wish.

It will be appreciated that the path definition process and the placement of virtual objects, features and zones with respect to the resultant virtual path may be combined with the AR marker techniques described herein.

In some situations during game play, within the game a user may not need to directly provide input to steer the vehicle. For example if the car 200 is travelling on a straight part of the track within the game the user could reasonably expect the car 200 to travel in a straight line with no input from them. However, where the vehicle steering means comprises servos, differences between the servos differences and manufacturing tolerances within the car 200 may cause the car to drift to one side or steer left or right to a certain extent. Therefore, a user may need to constantly correct the path of the car 200 in the real environment to ensure that the car stays on the virtual track.

In order to address this problem, the entertainment device 100 and/or the car 200 are able to cooperate with the vehicle steering means so as to "trim" the steering thus causing the car 200 to travel in a straight line when no user input is detected by the CPU 101.

In this case, the CPU 101 and/or the processor 205 are operable to detect, in dependence upon data generated from dead reckoning and/or optical flow, whether the path of the car 200 within the real environment is deviating from a desired path (e.g. a straight line) as defined with respect to a predetermined threshold, where the threshold is, for example, an angular deviation from the current trajectory that the vehicle is following. If the path of the car is detected to be deviating more than the predetermined threshold from the desired path, the CPU 101 and/or the processor 205 are operable to generate control signals to control the car so as to cause the car to follow the desired path. In an embodiment of the present invention, these control signals are generated using a known proportional-integral-differential (PID) control scheme with respect to the deviation from the predetermined threshold although it will be appreciated that other appropriate control schemes could be used. Alternatively, where the deviation is a constant offset, this offset can be trimmed to zero and the trimming value stored in a set-up file on the entertainment device 100 or in the memory 210 of the car 200 so that calibration does not have to be carried out each time the car is used. This also has the added advantage that a processing load on the CPU 101 and/or the processor 205 is reduced.

Additionally, where a user input device that generates a digital output is used to control the car (e.g. the left and right joy pads 106 and 108), the entertainment device 100 is operable to generate control signals such that the responsiveness of the steering is dependent upon the speed at which the car 200 is travelling. For example, at high speeds with respect to the size and scale of the car 200, the CPU 101 generates control signals such that a user input that corresponds a steering command causes only a small angular deviation from the car's current course. However, at low speeds (with respect to the size and scale of the car 200) each steering command has a correspondingly larger angular deviation associated with it so as to assist in low speed manoeuvrability. Optionally, set-up files can be stored either on the entertainment device 100 and/or the car 200 that store data relating to the set-up of the car such as the straight line trimming, the high speed/low speed steering parameters and the like. As described above, these set-up files can be used each time the game is played or the car 200 is used so as to reduce the need to re-calibrate and to reduce processing requirements.

In a further embodiment of the present invention, multi-player games may be played between users each having their own car with respective entertainment device. In this case, the entertainment devices are additionally operable to communicate with each other via the transmitting/receiving means 120 as in a standard multiplayer game situation. Typically, the maximum number of users in a multiplayer game is six although it will be appreciated that any number of users could take part depending on the bandwidth of the wireless link 225 and the processing power available in the entertainment device.

For example, the players could race around a route as determined by the AR markers as described above. Furthermore, players can drop virtual mines or other obstacles or fire virtual missiles to impede another player's progress. Additionally, virtual smoke could be released from a user's car and thus obscure an opponent's view of the video images captured by the video camera. For example, dropping a mine slows a user's own car down by 3 seconds but an opponent's car down by 10 seconds if they are unfortunate enough to hit the mine. However, there is a better chance of knocking out an opponent's car if they are close behind, whilst if they are further away, there is a greater risk that the lead will be lost if they succeed in avoiding the obstacle.

To achieve this functionality, at least the entertainment device corresponding to the user who did not drop the mine needs to know where the mine is dropped. This can be achieved by the mine-dropping user's entertainment device deriving a position using the techniques described above, i.e. dead reckoning, or by triangulation between AR markers. Alternatively, if the mine-dropping car is in view of the camera of a following car, the following car can note (in response to a signal originating at the entertainment device which dropped the mine) the relative position of the car in front at the instant that the mine was dropped.

Optionally, in the case where a user owns two or more remotely controlled cars in accordance with embodiments of the present invention, the entertainment device 100 is operable to control at least one of the cars as a computer controlled car within the game by generating appropriate control signals that are then transmitted to the car. Additionally, as described above, the entertainment device 100 may record the position of the user's car as it goes around the track so as to generate the "ghost car" instead of, or as well as, recording the sequence of control commands that were used to guide the car 200 around the track. Optionally, where the user only owns one car, a record of a previous lap is stored and used to generate the ghost car. Here, the ghost car is superimposed on the virtual race track using alpha blending.

Additionally, the entertainment device 100 is operable to display video images from two or more remotely controlled cars according to embodiments of the present invention using a split screen display. In this case, the number of cars that can send video images to one entertainment device 100 is limited by the bandwidth of the communication link 225.

When the augmented reality game play mode is used with multiple players, the car 200 may additionally comprise an augmented reality marker or markers. The CPU 101 is operable to detect these markers as described above so that the appearance of the vehicles may be altered when they are rendered together with the captured video images on the display 102. In this case, the augmented reality image of the appearance of the vehicle is rendered as a graphical overlay superimposed on the captured video image of the car 200. For example, a user could customise the virtual appearance of their car 200 so that is represented within the game as a so-called monster truck, motorcycle, tractor or such like. Additionally, the CPU 101 is operable to detect the AR marker of a different car. Therefore, the CPU 101 can generate a virtual race track in dependence upon the path followed by that car or detect when if that car crashes.

Furthermore, by attaching AR markers to the car 200, extra game functionality can be realised as the position of each car with respect to the others can be determined. For example, virtual missiles could be fired by one of the cars participating in the game and the CPU 101 of the entertainment device 100 would be able to detect whether the target car was hit in dependence upon the relative position and relative orientation of the car firing the missile with respect to the target vehicle.

As described above, so as to be able to detect if a collision has occurred between the car 200 and another object such as another player's car, the remotely controlled car 200 optionally comprises an accelerometer and/or a bumper or buffer operably coupled to a switch that closes when the bumper is pressed. The processor 210 is operable to detect a collision in dependence upon a signal received from the accelerometer and/or the bumper via the communication bus 230. The processor is then operable to generate a collision data signal that is transmitted to the entertainment device 100 from the transmitter 215 via the communication link 225. Therefore, for example, during the playing of the racing game as described above, points or penalties may be imposed if a collision is detected.

Additionally, as described above, the remotely controlled car 200 comprises a distance measuring means operable to detect the distance between the car and another object. The distance measuring means is operable to communicate with the processor 205 via the communication bus 230. Typically, the distance measuring means comprises an infrared distance measuring device known in the art although it will be appreciated that any suitable distance measuring technique such as ultrasound, laser reflection, and the like could be employed.

The processor 205 is operable to detect the distance between the distance measuring means and another object in dependence upon data signals received via the communication bus 230 from the distance measuring means. The processor 205 accordingly generates "distance to object" data that is sent to the entertainment device 100 via the communication link 225. For example, the distance to object data may be used by the entertainment device to detect the distance to different objects within the filed of view of the camera 220 so as to assist in marker detection if one of the AR markers is partially occluded by another object. The distance to object data may also optionally be used in generating the path data that relates to the path 605 of the car 200 in the real environment as described above.

Optionally, if the CPU 101 detects that the distance between the car 200 and another object is within a predetermined distance, the CPU 101 generates a collision prevention control signal similar to that generated when a "no entry" marker is detected as described above thus reducing the likelihood that the car 200 will collide with another object. However, during the playing of, for example, multiplayer racing games this feature may be disabled by a user, should they so wish, so as to add to the realism of the game, or it may be automatically deselected in accordance with signals generated by the game software. Alternatively, the processor 205 of the remotely controlled car 200 may generate the collision prevention control signal in accordance with the signals received from the distance measuring means.

As described above, the remotely controlled car 200 may optionally comprise a battery charge detection means. The battery charge detection means is operable to generate and send battery charge level signals to the processor 205 via the communication bus 230 or to the entertainment device 100 via the communication link 225 using the transmitting/receiving means (Tx/Rx) 215 that relate to the amount of charge stored in the battery. Therefore, when the battery charge drops below a predetermined level, a warning can be displayed on integral display 102 of the entertainment device 100. The system can also generate a virtual fuel level within a game, which may or may not be independent of the real battery charge level. For example, when the battery charge level reaches a predetermined level, the user has to drive their car 200 to the virtual reality petrol pump 315 associated with the appropriate AR marker as described above.

The use of a RF transponder as an AR marker will now be described.

According to an embodiment of the present invention, the AR marker may be an RF transponder rather than a visible marker that is detected within the captured video images. In this case the car 200 additionally comprises a transponder communication means operable to transmit radio frequency signals and to detect RF signals transmitted by the transponder in response to an interrogation by the transponder detection means. The transponder communication means is able to communicate with the processor 205 of the car 200 via the communication bus 230. Typically, the RF transponder is a radio frequency identification (RFID) tag in accordance with known technology although any suitable RF transponder could be used.

The transponder communication means is operable to generate signal strength data that relates to the detected the signal strength of a transponder return signal transmitted by the RFID tag. The transponder return signal is transmitted by the RFID tag in response to an interrogation signal sent by the transponder communication means and comprises data that relates to the identification of that tag. The signal strength data is sent to the entertainment device 100 via the communication link 225. The CPU 101 then generates transponder distance data that indicates how far away the car 220 is from the transponder. Typically, the RFID tag is a passive device although it will be appreciated that an active device or semi-passive device could be used.

In order to generate position information that describes the position of the RF AR marker with respect to the car 200, according to an embodiment of the invention, different techniques may be employed.

Typically, the signal strength of the transponder is recorded at a first position of the car 200 within the real environment. As the car moves within the real environment, the signal strength of the transponder is recorded at different positions so as to enable the CPU 101 to triangulate the position of the AR marker based on the signal strength data generated at different positions of the car 200 within the environment. To improve the accuracy of the triangulation, the signal strength data can be combined with the distance data generated by the distance measuring means and/or data generated by the CPU 101 or the processor 205 when carrying out dead reckoning. Optionally, if the car 200 loses track of where the marker is, the processor 205 can generate control signals that cause the car to drive backward and forward over a short distance so that the signal strength of the transponder at predetermined positions along that path can be detected. The position of the AR marker can then be triangulated from the signal strength data generated at those positions. This feature can also be employed at the start of a game before the user has had the chance to drive the car 200 around the environment.

Additionally, each transponder comprises a unique identification code so that is can be uniquely identified within the environment. Therefore, as described above, the entertainment device 100 may detect the position of all the AR markers within the real environment before the user starts playing the game. Optionally, the transponder communication means comprises an antenna array so that the position of the RF AR marker can be detected based on signals received from the transponder at each antenna of the array using known techniques.

It will be appreciated that an RF transponder may be combined with a visual marker so as to create an AR marker that may be used in accordance with embodiments of the present invention. Additionally, it will be appreciated that the instead of the RF transponder, an RF transmitter could be used as the RF AR marker.

The position of the car 200 with respect to the entertainment device 100 may also be determined in dependence upon the signal strength of the signal transmitted and received between the two devices via the wireless communication link 225 using techniques such as those described above in relation to the RFID tag AR markers.

As mentioned above, the car 200 may optionally comprise a battery charge detection means. Additionally, as described above, the battery 245 may be recharged by inductive coupling with a charging station. In accordance with an embodiment of the present invention, the charging station may comprise an AR marker such as the visual AR marker or the RF AR marker described above. Therefore, the CPU 101 of the entertainment device can detect the position of the car 200 relative to the car 200 as described above. Additionally, the CPU 101 is operable to detect when the level of charge stored in the battery falls below a predetermined level independence upon battery charge data generated by the battery charge detection means and sent from the car 200 to the entertainment device 100 via the communication link 225. If the CPU 101 detects that the level of charge stored is below the predetermined level (i.e. the battery charge is low), the CPU 101 can generate control signals to drive the car 200 to the charging station based on the detected position of the AR marker attached to the charging station. Alternatively, the processor 205 of the car 200 may carry out this detection based on signals generated by the battery charge detection means and generate control signals accordingly. Thus the battery 245 of the car 200 can be kept charged even if the user does not use the car 200 for a time period. To prevent this feature from interrupting game play, a user can de-select this option at a set-up stage of the game using the integral display 102 and an input device such as the left or right joypad.

Figure 7:
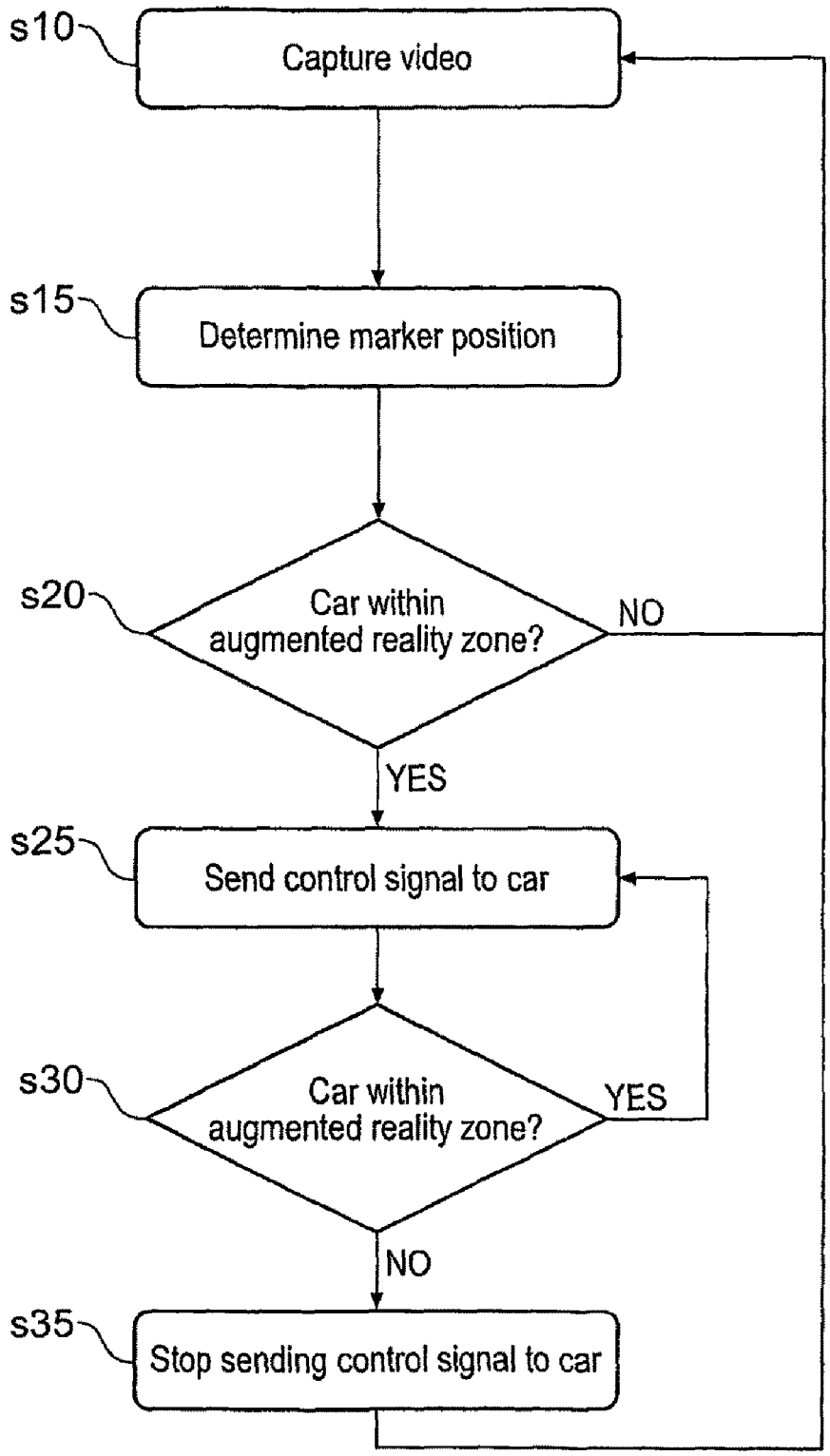
FIG. 7 is a flowchart of a method of controlling the remotely controlled toy in accordance with an embodiment of the present invention.

A method of controlling the remotely controlled toy in accordance with an embodiment of the present invention will now be described with reference to FIG. 7. FIG. 7 shows a flowchart of an example process used to control the remotely controlled car 200 and to detect whether the car is within the augmented reality zone 410.

At a step s10, video images are captured by the video camera 220 an sent to the entertainment device 100 via the communication link 225.

Then, at a step s15, the CPU 101 of the entertainment device detects the AR marker 405 in accordance with image recognition techniques known in the art as described above. At the step s15, the CPU 101 additionally detects the relative position of the car 200 with respect to the AR marker 405 using any or all of: dead reckoning; the distance information generated by the distance measuring means; and distance estimation data generated in dependence upon the image size of the AR marker 405 within the captured video images.

At a step s20, the CPU 101 compares the measured position of the car 200 with respect to the AR marker 405 with a AR zone threshold distance to determine whether the car is within the AR zone 405. If the car is not detected to be within the AR zone, then the CPU 101 does not generate any control signals that would over-ride the control signals generated by the user input device and the process passes to the step s10.

However, if the car 200 is detected to be within the AR zone 405, then, at a step s25, the CPU 101 generates a vehicle control signal and transmits it to the car via the communication link 225. For example, the AR zone 405 might correspond to a virtual oil slick as described above. In this case, the CPU 101 would generate the "oil slick" control signal as described in Table 1 above and transmit this signal to the car. Then, the process passes to a step s30 to detect whether the car is still within the AR zone 405 as described above. If it is, then control passes to the step s25. However, if the car has left the AR zone 405 then control passes to a step s35.

At the step s35, the CPU generates a signal to stop sending the control signal to the car 200 so that control of the car is returned solely to the user. The control process then returns to the step s10.

It will be appreciated that the above features and aspects of the above described embodiments of the present invention may be used in various different ways in game play scenarios. For example, a user may be presented with a series of manoeuvres or tasks that they have to perform to achieve a certain skill level or "licence". On successfully completing those manoeuvres and tasks, they are awarded with extra functionality such as ABS or nitro boost. Additionally, they could be allowed to try for a more difficult licence or be awarded with a pre-programmed manoeuvre as described above. Optionally, the entertainment system 100 can compile statistics that relate to any aspect of the car 200 such as top speed, top revs, time played, photos taken, videos recorded, jumps completed and the like. This data can be used to generate a game score or to allow a user to access extra features of the car 220 or the game when certain targets are attained.

Although the above described embodiments of the present invention have been described with reference to a Sony® PlayStation Portable (PSP) acting as the entertainment device 100, it will be appreciated that any suitable entertainment device could be used. For example, a Sony® PlayStation 3 entertainment system (PS3) could act as the entertainment device 100. Here, a game controller of the PlayStation 3® may be used to control the toy with similar functionality to that described above with reference to the PSP. Optionally, other peripheral devices such as the PlayStation Portable device may be used as a controller for the PlayStation 3®, for example by communicating wirelessly between the PSP and the PS3 using the wireless communication link 120.

It will be appreciated that in embodiments of the present invention, elements of the entertainment method may be implemented in the entertainment device and the remotely controlled toy in any suitable manner. Thus adapting existing parts of a conventional entertainment device may comprise for example reprogramming of one or more processors therein. As such the required adaptation may be implemented in the form of a computer program product comprising processor-implementable instructions stored on a data carrier such as a floppy disk, optical disk, hard disk, PROM, RAM, flash memory or any combination of these or other storage media, or transmitted via data signals on a network such as an Ethernet, a wireless network, the Internet, or any combination of these or other networks.

The invention claimed is:

1. An entertainment system comprising a remotely controlled toy and an entertainment device operable to communicate using a data communications link with the remotely controlled toy:

the remotely controlled toy having a video camera operable to capture video images of a real environment, the remotely controlled toy comprising:

a controller operable to control behaviour of the remotely controlled toy; and a control data receiver operable to receive, via the data communications link, the control data generated by the entertainment device, in which the controller is operable to modify the behaviour of the remotely controlled toy in dependence upon the control data received from the entertainment device; and the entertainment device comprising:

a transmitter operable to transmit, via the data communications link, control data to the remotely controlled toy that relates to the control of the remotely controlled toy;

a receiver operable to receive, from the data communications link, video images captured by the video camera of the remotely controlled toy;

a detector operable to detect a real environment feature within the real environment;

a processor operable to generate a virtual image feature comprising a computer generated object in dependence upon the detected real environment feature; and a display arrangement operable to generate a combined display of the captured video images and the virtual image feature such that the virtual image feature is arranged and displayed together with the received video images so that the display position of the virtual image feature corresponds to the position of the real environment feature within the received video images.

2. A system according to claim 1, the real environment feature being an image feature that relates to a predetermined feature within the real environment and the image feature being detected within the received video images.

3. A system according to claim 1, in which:

the real environment feature is a radio frequency communication device; and the remotely controlled toy comprises a transponder communicator operable to detect radio frequency signals transmitted by the radio frequency communication device.

4. A system according to claim 3, in which:

the transponder communicator is operable to generate radio frequency signal strength data in dependence upon the detected signal strength of the radio frequency signal transmitted by the radio frequency communication device;

the remotely controlled toy is operable to transit the signal strength data to the entertainment device via the communication link; and the processor is operable to detect the position of the real environment feature within the real environment in dependence upon the signal strength data generated by the transponder communicator.

5. A system according to claim 3, in which:

the radio frequency communication device comprises a radio frequency transponder; and the transponder communicator is operable to transmit radiofrequency signals to the radio frequency transponder and to detect radio frequency signals transmitted by the transponder in response to an interrogation by the transponder communicator.

6. A system according to claim 5, in which the radio frequency transponder comprises a radio frequency identification tag.

7. A system according to claim 1, in which: the processor is operable to alter the control data in dependence upon an attribute associated with the virtual image feature.

8. A system according to claim 7, in which:

the processor is operable to transmit attribute-defining data in dependence upon an attribute associated with the virtual image feature; and the remotely controlled toy comprises storage operable to store program code that causes the controller to modify the behaviour of the remotely controlled toy in dependence upon the attribute-defining data received from the entertainment device.

9. A system according to claim 8, in which:

the processor is operable to generate update program code that relates to the control of the remotely controlled toy;

the transmitter is operable to transmit the update program code to the remotely controlled toy via the data communication link; and the controller is operable to update the program code stored in the storage in dependence upon the update program code data received from the data communication link sent by the entertainment device.

10. A system according to claim 7, in which:

the processor is operable to detect whether the distance between the remotely controlled toy and the predetermined feature is less than a predetermined threshold distance; and the processor is operable to alter the control data in respect of that predetermined feature if the detected distance is less than the predetermined threshold distance.

11. A system according to claim 1, in which:

the control data represents user input control data that relates to input by a user; and the entertainment device comprises user a input device operable to generate the user input control data in dependence upon the input by the user.

12. A system according to claim 1, in which the virtual image feature comprises a game feature of a game associated with the entertainment device.

13. A system according to claim 12, in which the processor is operable to generate the control data in dependence upon game processes generated by the game associated with the entertainment device.

14. A system according to claim 1, in which:

the transmitter is operable to transmit audio data to the remotely controlled toy using the data communications link, in which the audio data relates to audio content associated with the entertainment device; and the remotely controlled toy comprises an audio reproducer operable to reproduce the audio content in dependence upon the audio data received via the data communications link from the entertainment device.

15. A system according to claim 14, in which the audio content associated with the entertainment device comprises data according to Motion Pictures Expert Group 1 level 3 (MP3) standard.

16. A system according to claim 1, in which the data communication link comprises a wireless communication link.

17. A system according to claim 1, in which:

the entertainment device comprises a motion sensor operable to detect motion of the entertainment device; and the processor is operable to generate the control data in dependence upon the detected motion of the entertainment device.

18. A system according to claim 1, in which, in response to a user input, the processor is operable to generate control data that, when transmitted to the toy via the communication link, causes the toy to carry out a sequence of predetermined actions.

19. A system according to claim 18, in which:

the toy comprises an instruction storage; and data relating to the sequence of predetermined actions is stored in the instruction storage.

20. An entertainment system comprising:

a remotely controlled toy having a video camera operable to capture video images of a real environment, the position of the toy being associated with a real path within the real environment; and an entertainment device operable to communicate using a data communications link with the remotely controlled toy, the device comprising:

a transmitter operable to transmit, via the data communications link, control data to the remotely controlled toy that relates to the control of the remotely controlled toy;

a receiver operable to receive, from the data communications link, video images captured by the video camera of the remotely controlled toy;

a detector operable to detect the real path of the toy within the real environment and generate real path data in dependence upon the detected real path;

a processor operable to generate a virtual path in dependence upon the real path data generated by the detector and to generate a virtual image feature comprising a computer generated object in dependence upon the virtual path; and a display arrangement operable to generate a combined display of the captured video images and the virtual image feature such that the virtual image feature is arranged and displayed together with the received video images so that the display position of the virtual image feature corresponds to the position of the real environment feature within the received video images.

21. A system according to claim 20, in which the detector is operable to detect the position of the toy with respect to the real environment in dependence upon optical flow data generated by the processor using the video images captured by the video camera.

22. A system according to claim 20, in which the detector is operable to detect the real path of the toy in dependence upon a comparison between a current detected position of the toy with respect to a previous detected position of the toy.

23. A system according to claim 20, in which:

the detector is operable to:

detect the position of the toy with respect to the real environment in dependence upon optical flow data generated by the processor using the video images captured by the video camera so as to generate a first virtual path; and detect the real path of the toy in dependence upon a comparison between a current detected position of the toy with respect to a previous detected position of the toy so as to generate a second virtual path; and the processor is operable to detect difference between data relating to the first virtual path and data relating to the second virtual path and, if that detected difference is less than a predetermined threshold, generate the virtual image feature in dependence upon any one of:

the first virtual path;

the second virtual path; and an average of the data defining the first virtual path and the second virtual path.

24. A system according to claim 23, in which, if the detected difference is greater than the predetermined threshold, the processor is operable to not generate the virtual image feature.

25. A system according to claim 20, in which:

the detector is operable to detect the path of the toy by detecting the position of the toy with respect to the real environment at predetermined time intervals; and the processor is operable to generate the virtual path by interpolating the real path data generated by detecting the position of the toy at predetermined time intervals.

26. An entertainment device operable to communicate using a data communications link with a remotely controlled toy having a video camera operable to capture video images of a real environment, the device comprising:

a transmitter operable to transmit, via the data communications link, control data to the remotely controlled toy that relates to the control of the remotely controlled toy;

a receiver operable to receive, from the data communications link, the video images captured by the video camera of the remotely controlled toy;

a detector operable to detect a real environment feature within the real environment;

a processor operable to generate a virtual image feature comprising a computer generated object in dependence upon the detected real environment feature; and a display arrangement operable to generate a combined display of the captured video images and the virtual image feature such that the virtual image feature is arranged and displayed together with the received video images so that the display position of the virtual image feature corresponds to the position of the real environment feature within the received video images; and the remotely controlled toy comprising:

a controller operable to control behaviour of the remotely controlled toy; and a control data receiver operable to receive, via the data communications link, the control data generated by the entertainment device, in which the controller is operable to modify the behaviour of the remotely controlled toy in dependence upon the control data received from the entertainment device.

27. A device according to claim 26, in which:

the control data comprises attribute control data that relates to an attribute associated with the virtual image feature; and the processor is operable to generate the attribute control data in dependence upon the attribute associated with the virtual image feature.

28. A device according to claim 27, in which the attribute control data causes the remotely controlled toy to modify behaviour of the remotely controlled toy.

29. An entertainment device operable to communicate using a data communications link with a remotely controlled toy having a video camera operable to capture video images of a real environment, the position of the toy being associated with a real path within the real environment; the device comprising:

a transmitter operable to transmit, via the data communications link, control data to the remotely controlled toy that relates to the control of the remotely controlled toy;

a receiver operable to receive, from the data communications link, the video images captured by the video camera of the remotely controlled toy;

a detector operable to detect the real path of the toy within the real environment and generate real path data in dependence upon the detected teal path;

a processor operable to generate a virtual path in dependence upon the real path data to generated by the detector and to generate a virtual image feature comprising a computer generated object in dependence upon the virtual path; and a display arrangement operable to generate a combined display of the captured video images and the virtual image feature such that the virtual image feature is arranged and displayed together with the received video images so that the display position of the virtual image feature corresponds to the position of the real environment feature within the received video images.

30. A device according to claim 29, in which:

the position of the toy is associated with a real path within the real environment;

the detector is operable to detect the real path of the toy within the real environment and generate real path data in dependence upon the detected real path; and the processor is operable to generate a virtual path in dependence upon the real path data generated by the detector and to generate the virtual image feature in dependence upon the virtual path.

31. A device according to claim 30, in which:

the detector is operable to:

detect the position of the toy with respect to the real environment in dependence upon optical flow data generated by the processor using the video images captured by the video camera so as to generate a first virtual path; and detect the real path of the toy in dependence upon a comparison between a current detected position of the toy with respect to a previous detected position of the toy so as to generate a second virtual path; and the processor is operable to detect difference between data relating to the first virtual path and data relating to the second virtual path and, if that detected difference is less than a predetermined threshold, generate the virtual image feature in dependence upon any one of:

the first virtual path;

the second virtual path; and an average of the data defining the first virtual path and the second virtual path.

32. A tangible, non-transitory data carrier recorded with computer readable instructions that when executed by a computer, cause the computer to operate as an entertainment device in accordance with claim 26.

33. A remotely controlled toy operable to communicate using a data communications link with an entertainment device, the remotely controlled toy comprising:

a video camera operable to capture video images of a real environment;

a transmitter operable to transmit, via the data communications link, the video images captured by the video camera to the entertainment device;

a receiver operable to receive, from the data communications link, control data generated by the entertainment device that relates to the control of the remotely controlled toy; and a controller operable to control behaviour of the remotely controlled toy, in which:

the control data comprises attribute control data that relates to an attribute associated with a virtual image feature comprising a computer generated object generated by the entertainment device, the virtual image feature being generated by the entertainment device in dependence upon a detection by the entertainment device of a real environment feature within the real environment; and the controller is operable to modify the behaviour of the remotely controlled toy in dependence upon the attribute control data received from the entertainment device.

34. A toy according to claim 33, comprising one or more selected from the list consisting of:

a horn;

an accelerometer operable to detect an impact with the toy;

a bumper or buffer operably coupled to a switch to detect an impact between the toy and another object;

an audio reproducer;

a microphone;

a light source;

a projectile firing device operable to fire projectiles;

a battery charge detector operable to detect the amount of charge in a battery used to power the remotely controlled toy; and a distance measurer operable to detect the distance between the toy and another object.

35. A toy according to claim 34, having a distance measurer, in which the controller is operable to:

detect, in dependence upon a signal generated by the distance measurer, whether the relative distance between the remotely controlled toy and the detected image feature is less than a predetermined threshold distance; and modify the behaviour of the remotely controlled toy if the detected relative distance is less than the predetermined threshold distance.

36. A toy according to claim 33, comprising storage operable to store program code that causes the controller to modify the behaviour of the remotely controlled toy in dependence upon the attribute control data received from the entertainment device.

37. A toy according to claim 36, in which the controller is operable to update the program code stored in the storage in dependence upon update program code data generated by the entertainment device and received via the data communication link from the entertainment device.

38. A remotely controlled toy operable to communicate using a data communications link with an entertainment device, the remotely controlled toy comprising:

a video camera operable to capture video images of a real environment;

a transmitter operable to transmit, via the data communications link, the video images captured by the video camera to the entertainment device;

a receiver operable to receive, from the data communications link, control data generated by the entertainment device that relates to the control of the remotely controlled toy; and a controller operable to control behaviour of the remotely controlled toy, in which:

the control data comprises attribute control data that relates to an attribute associated with a virtual image feature comprising a computer generated object generated by the entertainment device, the virtual image feature being generated by the entertainment device in dependence upon a detection by the entertainment device of a position of the remotely controlled toy with respect to the real environment; and the controller is operable to modify the behaviour of the remotely controlled toy in dependence upon the attribute control data received from the entertainment device.

39. An entertainment method for controlling a remotely controlled toy having a video camera operable to capture video images of a real environment and an entertainment device operable to communicate using a data communications link with the remotely controlled toy, the method comprising:

transmitting, via the data communications link, control data to the remotely controlled toy that relates to the control of and modifies the behaviour of the remotely controlled toy;

receiving, from the data communications link, video images captured by the video camera of the remotely controlled toy;

detecting a real environment feature within the real environment;

generating a virtual image feature comprising a computer generated object in dependence upon the detected real environment feature; and generating a combined display of the captured video images and the virtual image feature such that the virtual image feature is arranged with respect to the video images so as to correspond to the position of the real environment feature within the real environment.

40. An entertainment method for controlling a remotely controlled toy having a video camera operable to capture video images of a real environment and an entertainment device operable to communicate using a data communications link with the remotely controlled toy, the position of the toy being associated with a real path within the real environment; the method comprising:

transmitting, via the data communications link, control data to the remotely controlled toy that relates to the control of the remotely controlled toy;

receiving, from the data communications link, video images captured by the video camera of the remotely controlled toy;

detecting the real path of the toy within the real environment and generating real path data in dependence upon the detected real path;

generating a virtual path in dependence upon the real path data and generating a virtual image feature comprising a computer generated object in dependence upon the virtual path; and generating a combined display of the captured video images and the virtual image feature such that the virtual image feature is arranged with respect to the video images so as to present the virtual image feature at a predetermined position within the real environment.

41. A tangible, non-transitory data carrier recorded with computer readable instructions that when executed by a computer, cause the computer to carry out the method of controlling a remotely controlled toy in accordance with claim 39 or 40.

42. A tangible, non-transitory data carrier recorded with computer readable instructions that when executed by a computer, cause the computer to carry out the method of controlling a remotely controlled toy in accordance with claim 40.

* * * * *

UNITED STATES PATENT AND TRADEMARK OFFICE

CERTIFICATE OF CORRECTION

PATENT NO. : 8,216,036 B2
APPLICATION NO. : 12/595075
DATED : July 10, 2012
INVENTOR(S) : Adriana Maria Eyzaguirre and Peter John Hodges It is certified that error appears in the above-identified patent and that said Letters Patent is hereby corrected as shown below:

In the Specifications

Col. 1, Line 62, "to attribute" should read -- attribute --.
Col. 2, Line 32, "is disclosed" should read -- are disclosed --.
Col. 3, Line 20, "to entertainment" should read -- entertainment --.
Col. 3, Line 29, "with a" should read -- a --.
Col. 4, Line 59, "four wheel" should read -- four-wheel --.
Col. 6, Line 49, "speed to" should read -- speed --.
Col. 6, Line 67, "to communicating" should read -- communicating --.
Col. 8, Line 32, "to real" should read -- real --.
Col. 8, Line 56, "three dimensional" should read -- three-dimensional --.
Col. 8, Line 57, "two dimensional" should read -- two-dimensional --.
Col. 9, Line 55, "tyre" should read -- tire --.
Col. 9, Line 65, "tyre" should read -- tire --.
Col. 10, Line 25, "tyre" should read -- tire --.
Col. 12, Line 10, "example, circle" should read -- example, a circle --.
Col. 12, Line 11, "to marker" should read -- marker --.
Col. 12, Line 60, "the operable" should read -- operable --.
Col. 13, Line 65, "execute" should read -- executes --.
Col. 15, Line 3, "operable generate" should read -- operable to generate --.
Col. 16, Line 11, "servos" should read -- servos' --.
Col. 19, Line 27, "the signal" should read -- signal --.
Col. 20, Line 52, "an sent" should read -- and sent --.
Col. 20, Line 64, "a AR" should read -- an AR --.

In the Claims

Claim 5, Col. 22, Line 61, "radiofrequency" should read -- radio frequency --.
Claim 11, Col. 23, Line 35, "user a" should read -- a user --.
Claim 29, Col. 26, Line 3, "teal path" should read -- real path --.
Claim 32, Col. 26, Line 46, "that when" should read -- that, when --.
Claim 34, Col. 27, Line 15, "projectile firing" should read -- projectile-firing --.

Signed and Sealed this
Fourteenth Day of January, 2014

Michelle K. Lee

Michelle K. Lee
*Deputy Director of the United States Patent and Trademark Office*

Claim 41, Col. 28, Line 53, “that when” should read -- that, when --.
Claim 42, Col. 28, Line 58, “that when” should read -- that, when --.